US011353180B2

(12) United States Patent
Yao et al.

(10) Patent No.: US 11,353,180 B2
(45) Date of Patent: Jun. 7, 2022

(54) LED LAMP

(71) Applicant: JIAXING SUPER LIGHTING ELECTRIC APPLIANCE CO., LTD, Jiaxing (CN)

(72) Inventors: Zhixiong Yao, Jiaxing (CN); Tao Jiang, Jiaxing (CN); Aiming Xiong, Jiaxing (CN); Lin Zhou, Jiaxing (CN); Jian Lu, Jiaxing (CN); Mingbin Wang, Jiaxing (CN); Zhichao Zhang, Jiaxing (CN)

(73) Assignee: JIAXING SUPER LIGHTING ELECTRIC APPLIANCE CO., LTD, Jiaxing (CN)

( * ) Notice: Subject to any disclaimer, the term of this patent is extended or adjusted under 35 U.S.C. 154(b) by 1 day.

(21) Appl. No.: 16/944,118

(22) Filed: Jul. 30, 2020

(65) Prior Publication Data

US 2021/0048159 A1 Feb. 18, 2021

(30) Foreign Application Priority Data

| | | |
|---|---|---|
| Jul. 31, 2019 | (CN) | CN201910701977 |
| Sep. 2, 2019 | (CN) | CN201910846435 |
| Nov. 25, 2019 | (CN) | CN201911161961 |
| Dec. 30, 2019 | (CN) | CN201911395603 |
| Feb. 11, 2020 | (CN) | CN202010086708 |
| Apr. 1, 2020 | (CN) | CN202010248366 |
| Apr. 24, 2020 | (CN) | CN202010329607 |
| Jul. 13, 2020 | (CN) | CN202010667401 |

(51) Int. Cl.

| | |
|---|---|
| ***F21S 8/04*** | (2006.01) |
| ***F21V 23/02*** | (2006.01) |
| ***F21V 3/00*** | (2015.01) |
| ***F21V 19/00*** | (2006.01) |
| ***F21V 7/04*** | (2006.01) |
| ***F21Y 115/10*** | (2016.01) |

(52) U.S. Cl.

CPC ..... *F21S 8/04* (2013.01); *F21V 3/00* (2013.01); *F21V 7/04* (2013.01); *F21V 19/003* (2013.01); *F21V 23/02* (2013.01); *F21Y 2115/10* (2016.08)

(58) Field of Classification Search

CPC ..... F21S 8/04; F21V 3/00; F21V 7/04; F21V 19/003; F21V 23/02; F21Y 2115/10

See application file for complete search history.

(56) References Cited

U.S. PATENT DOCUMENTS

| | | | | |
|---|---|---|---|---|
| 7,731,396 | B2 * | 6/2010 | Fay | F21S 4/10 362/391 |
| 2009/0103331 | A1 * | 4/2009 | Pazula | H01R 33/94 362/649 |

(Continued)

FOREIGN PATENT DOCUMENTS

| | | | |
|---|---|---|---|
| CN | 103363354 | A | 10/2013 |
| CN | 103775876 | A | 5/2014 |

(Continued)

*Primary Examiner* — Mary Ellen Bowman
(74) *Attorney, Agent, or Firm* — Simon Kuang Lu

(57) ABSTRACT

An LED lamp comprises a lampshade, a base connected to the lampshade, a photoelectric module comprising a light source module and a power supply module disposed in an accommodating space formed between the lampshade and the base, the photoelectric module is detachably fixed to the base through a mounting portion.

20 Claims, 23 Drawing Sheets

(56) References Cited

U.S. PATENT DOCUMENTS

| | | | | |
|---|---|---|---|---|
| 2016/0025287 | A1 | 1/2016 | Philhower et al. | |
| 2017/0030530 | A1* | 2/2017 | Roys | F21V 23/003 |
| 2018/0320875 | A1* | 11/2018 | Cho | F21V 29/763 |

FOREIGN PATENT DOCUMENTS

| | | | | | |
|---|---|---|---|---|---|
| CN | 203656657 | U | | 6/2014 | |
| CN | 104100911 | A | * | 10/2014 | |
| CN | 104100911 | A | | 10/2014 | |
| CN | 104295952 | A | | 1/2015 | |
| CN | 105402618 | A | | 3/2016 | |
| CN | 205606410 | U | | 9/2016 | |
| CN | 206708963 | U | | 12/2017 | |
| CN | 107830478 | A | * | 3/2018 | |
| CN | 207350040 | U | | 5/2018 | |
| CN | 208509377 | U | * | 2/2019 | |
| CN | 208509377 | U | | 2/2019 | |
| WO | WO-2017214893 | A1 | * | 12/2017 | F21S 8/04 |

* cited by examiner

LED LAMP

CROSS-REFERENCE TO RELATED APPLICATIONS

This application claims priority to the following Chinese Patent Applications No. 201910701977.9 filed on 2019 Jul. 31, No. 201910846435.0 filed on 2019 Sep. 2, No. 201911161961.X filed on 2019 Nov. 25, No. 201911395603.5 filed on 2019 Dec. 30, No. 202010086708.9 filed on 2020 Feb. 11, No. 202010248366.6 filed on 2020 Apr. 1, No. 202010329607.X filed on 2020 Apr. 24, No. 202010667401.8 filed on 2020 Jul. 13, the disclosures of which are incorporated herein in their entirety by reference.

BACKGROUND

Technical Field

The present disclosure relates to lighting apparatus, and more particularly, to an LED lamp.

Related Art

A ceiling lamp is a lamp ornament which is adsorbed or embedded into the ceiling of a roof, and is often used as a lighting device in various places such as home, office, and entertainment places. The traditional ceiling lamp is usually composed of a base, a light source module, a circuit module and a lamp shade. The light-emitting elements in the light source module are generally energy-saving lamp tubes. The light-emitting element of the ceiling lamp gradually replaces the energy-saving lamp tube with the LED, because the energy-saving lamp tube is polluted by mercury during production and after being discarded, and the power consumption of the energy-saving lamp tube is larger than that of the LED, and the LED has the characteristics of mercury free, non-toxic, no electromagnetic pollution, no harmful radiation, energy-saving, environmental protection, long service life and the like. However, the prior ceiling lamps still suffer from problems such as light emission, heat dissipation, installation, and packaging during use, as follows:

1. In the lighting process, there are flash, small illumination range, uneven illumination, low brightness in the central part of the lamp, uneven illumination in the central part of the lamp and the peripheral part of the lamp, uneven illumination on the light-emitting surface, glare, uneven illumination in the circumferential direction of the lamp, uneven illumination on the mounting surface of light-emitting element, uneven brightness and low color rendering, low light-emitting efficiency and light design, bright spots, low rendering effect, uneven color mixing, uneven illumination in the ceiling circumferential direction, light blocking due to the circuit elements with high height, high deviation in color temperature and color, narrow light orientation, low light transmission efficiency, low light-emitting efficiency of the light source, dim side area of the lampshade, uneven brightness in the light-emitting surface of the lampshade, generation of bright lines, low light extraction efficiency of the light-emitting elements, low light comfort, and low aesthetic feeling in extinction. Further, some use scenarios may require the light emitted by the lamp to have a three-dimensional effect or generate a corresponding light space according to a corresponding life scenario, a paper with hue have lower readability for users under the lamp, or the seniors have a low feeling of light comfort due to color saturation of letters and observed objects for seniors.

In order to improve the optical effect of the ceiling lamp, firstly, a backlight lens is added to the LED to reduce the dark area of the middle portion and the edge portion of the lamp, but the production cost is greatly increased and the product competitiveness is reduced due to the use of the backlight lens and the lens mounting technology. Secondly, optical components, such as light guide plates, lenses, or reflection units, are disposed between the light-emitting element and the lampshade. However, when the optical components are used, there are problems such as a change in the amount of light incident on the light guide plate, a complex structure of the optical member, an uneven brightness on the light guide plate, and a dark portion on the light guide plate.

2. The light-emitting elements and the circuit elements generate heat which affects the service life of the ceiling lamp;

3. The light source module is mostly installed in the lamp body by screws or pasted in the lamp body by adhesive, and is not easily removed and replaced after installation. In addition, after the ceiling lamp is used for a long time, aging and burnout of the light source module often occur. For example, when the light source module is damaged and needs to be replaced, the damaged light source module needs to be detached by tools, and then a new light source module is installed through the tools. The replacement operation of the LED light source module must be performed by professionals, which is not convenient.

4. The ceiling lamps are usually flat and have the characteristics of small occupation in height, wide illumination range, and the like. However, the overall thickness of the ceiling lamps is still large, and the overall volume of the ceiling lamps is also large, thereby increasing the packaging and inventory costs.

In addition, there are also problems such as low safety, low manufacturing efficiency, high use cost, easy access to the interior of the lamp such as insects and then affect aesthetic appearance, inability to continue lighting when the power supply is faulty, small installation area of a circuit board, low remote control sensitivity or narrow remote control range when intelligent control is performed, and noise during installation in order to make the lamp have a large luminous flux.

In summary, in view of the shortcomings and defects of the prior LED lamps, how to design an LED lamp to solve a technical problem of the prior art described above is expected to be solved by those skilled in the art.

SUMMARY

A number of embodiments of the present disclosure are described herein in summary. However, the vocabulary expression of the present disclosure is only used to describe some embodiments (whether or not already in the claims) disclosed in this specification, rather than a complete description of all possible embodiments. Some embodiments described above as various features or aspects of the present disclosure may be combined in different ways to form an LED lamp or a portion thereof.

The present disclosure is directed to an LED lamp and features in various aspects to solve the above problems.

The LED lamp comprises a lampshade and a base connected to the lampshade, wherein a photoelectric module is disposed in an accommodating space formed between the lampshade and the base. The photoelectric module comprises a light source module and a power supply module. The base comprises a mounting portion, and the photoelectric module is fixed onto the base through the mounting portion.

In some embodiments, the photoelectric module is detachably fixed to the base.

In some embodiments, the photoelectric module comprises a circuit board having a first side and a second side arranged relatively, wherein the first side is a side facing the lampshade, the electronic components of the light source module are disposed on the first side, and the electronic components of the power supply module are disposed on the second side.

In some embodiments, the photoelectric module further comprises an insulating unit having a first insulating portion and a second insulating portion, the first insulating portion covers the electronic components on the first side and the second insulating portion covers the electronic components on the second side.

In some embodiments, the circuit board comprises a plurality of LED chipsets disposed thereon, each of the plurality of the LED chipsets includes a plurality of LED chips, and each of the plurality of the LED chipsets is located on the same circumference. Assuming the number of the circumference is set to be n (n is greater than or equal to 1), the pitch angle of the LED chips may be set to be (90/n)°.

In some embodiments, the second side of the circuit board includes a third region for the power supply module to be disposed thereon and a fourth region, the first side includes a first region opposite to the third region and a second region opposite to the fourth region, and the number of the LED chips located in the first region is less than the number of the LED chips located in the second region.

In some embodiments, the second side of the circuit board includes a seventh region and a eighth region, and an electronic components of the power supply module include a heat generating component and a heat-sensitive component, where the heat generating component and the heat-sensitive component are located in the third region of the seventh side and the eighth region of the second side, respectively. the first side of the circuit board includes a fifth region opposite to the seventh region of the second side and a sixth region opposite to the eighth region of the second side, and the number of the LED chips located in the fifth region of the first side is less than the number of the LED chips located in the sixth region of the first side.

In some embodiments, a reflective member is disposed between the LED light source module and the power supply module, and the LED light source module surrounds the reflective member. The light source module comprises a circuit board and at least one set of the LED chipsets disposed on the circuit board, each of the LED chipsets comprises a plurality of LED chips, and the light emitting surface of the plurality of LED chips faces the central axis of the LED lamp.

In some embodiments, a Cartesian coordinate system having an X-axis, a Y-axis, and Z-axis is oriented for the LED lamp, wherein the Z-axis is parallel to the central axis of the LED lamp. A hole is formed in a central portion of the base, a supporting portion and an edge portion are formed around the hole. A gap formed between the supporting portion and the edge portion extends in a negative direction along the Z-axis to form a groove portion, and the supporting portion and the edge portion are in the same position in the positive direction of the Z-axis.

In some embodiments, there is also a gap between the photoelectric module and the supporting portion.

The present disclosure achieves one or any combination of the following advantages through the above-mentioned designs:

(1) The photoelectric module is rotationally fixed by the mounting portion, so that installation and maintenance are convenient, and work efficiency is improved; (2) adjusting the arrangement of the LED chips on the light source module so that the light emitting effect of the LED lamp is more uniform and the heat dissipation effect is more excellent; (3) the electronic components on the second side of the circuit board are located on the radially more inner side of the circuit board than any one of the electronic components of the light source modules, so that the electronic components on the second side of the circuit board can be prevented from being affected by the heat generated when the electronic components of the light source modules are operated, and the distribution area of the electronic components on the second side of the circuit board can be limited, thereby controlling the size of the second insulating portion to control the cost; (4) the LED chips and the power supply module are respectively located on the first side and the second side of the circuit board, and the number of the LED chips in the area corresponding to the power supply module on the first side is smaller than the number of the LED chips in the area not corresponding to the power supply module on the first side, so that on the one hand, the dark area in the middle of the LED lamp is significantly reduced, the luminous effect of the LED lamp is improved, and on the other hand, the influence of heat generated by the power supply module on the light source module can be reduced; (5) a second power supply module having a relatively high height is located in the groove portion of the base, so that the height of the ceiling lamp is effectively reduced because there is no need to provide a storage space for the power supply module, and the photoelectric module can be moved away from the lampshade so that the amount of light from the light source module to the edge of the lampshade is increased; (6) the first insulating portion has a certain degree of radian, so that the degree of stress of the first insulating portion can be increased to ensure that the photoelectric module is not damaged during transportation; (7) the second insulating portion is in contact with the side wall of the groove portion of the base to increase the contact area and improve the thermal conductivity; (8) the light-emitting surface of the LED chip faces the central axis of the lamp, thereby effectively eliminating the intermediate dark region and improving the light-emitting effect of the lamp; (9) the luminous flux of the LED lamp can be effectively improved by using a lampshade material having a refractive index n1 of the encapsulation layer of the LED lamp bead for selecting an appropriate refractive index; (10) an excellent optical effect can be obtained by providing a refractive index matching layer on the surface of the LED chip or the inner surface of the lampshade by the thickness design thereof.

DETAILED DESCRIPTION

In order to better understand the present disclosure, the present disclosure will be described more fully with reference to the accompanying drawings. The drawings show an embodiment of the disclosure. However, the present disclosure is implemented in many different forms and is not limited to the embodiments described below. Rather, these embodiments provide a thorough understanding of the present disclosure. The following directions such as "axial direction", "upper", "lower" and the like are for more clearly indicating the structural position relationship, and are not a limitation on the present invention. In the present invention, the "vertical", "horizontal", and "parallel" are defined as: including the case of ±10% based on the standard definition. For example, vertical usually refers to an angle of 90 degrees with respect to the reference line, but in the present invention, vertical refers to a condition including 80 degrees to 100 degrees. The operation circumstances and states of the LED lamp of the present disclosure is referring to the LED lamps are suspended vertically downward from the lampshade, as for exceptions will be further explained in the present disclosure.

As shown in FIGS. 1 to 48, the LED lamp of the embodiment of the present disclosure is, for example, a ceiling lamp mounted on a ceiling. The upper part of FIGS. 1 to 48 (the positive direction of the Z-axis in FIG. 1) corresponds to the direction of the floor surface opposite to the ceiling. In other words, the LED lamps shown in FIGS. 1 to 48 are adapted to the opposite state when in normal use.

Figure 1:
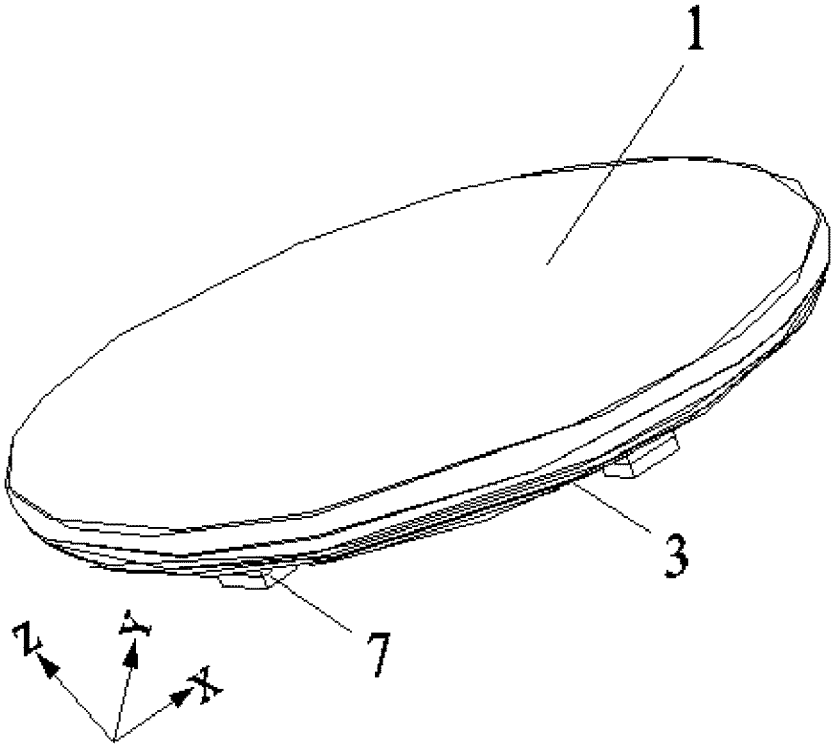
FIG. 1 is a schematic structural diagram of an embodiment of an LED lamp according to the present disclosure.

The LED lamps in the present disclosure are spatially located in a Cartesian coordinate system as shown in FIG. 1, wherein the Z-axis is parallel to the central axis of the LED lamps. As shown in FIGS. 1 to 48, an LED lamp comprises a lampshade 1 and a base 3 connected to the lampshade 1. A photoelectric module 2 is disposed in a accommodating space formed between the lampshade 1 and the base 3. In some embodiments, the LED lamp further comprises a mounting portion 31 disposed on the base 3, a hanger 4, and an adapter hanger (or adapter) 5. The photoelectric module 2 is fixed onto the base 3 through the mounting portion 31, and the hanger 4 is connected to the adapter 5. Between the LED lamp and the ceiling, in order to suppress the shaking of the LED lamp, a buffer member 7 is provided, which can be a sponge, for example.

As shown in FIGS. 1 to 48, the photoelectric module 2 comprises a light source module 22 and a power supply module 23. In order to prevent a power failure or the like when an external power supply is out of supplying, the power supply module 23 comprises a storage battery unit for storing electric energy. In some embodiments, the storage battery unit further comprises a glow module, and the glow module automatically emits glow light to ensure safety.

As shown in FIGS. 1 to 48, the photoelectric module 2 is configured in a unitary structure, and is detachably fixed to the base 3. Therefore, when the photoelectric module 2 is damaged, it can be replaced separately, which is more cost-effective than the whole lamp replacement. It is necessary to prevent the occurrence of electric shock and, in particular, to prevent the electronic components from being touched by hand when the photoelectric module 2 is replaced. The photoelectric module 2, in some embodiments, includes electronic components, and insulation units are provided outside the electronic components, so as to prevent contacting the electronic components when the photoelectric module 2 is replaced. The photoelectric module 2 further comprises a circuit board 201, which can be a PCB single panel or a PCB double panel, on which at least part of the electronic components are arranged. Further, all electronic components are disposed on the circuit board 201. The electronic components include electronic components in the light source module 22, such as LED beads, and electronic components in the power supply module 23. That is, the electronic components of the light source module 22 and the electronic components of the power supply module 23 are integrally formed on the same circuit board, thereby saving cost and space.

Figure 3:
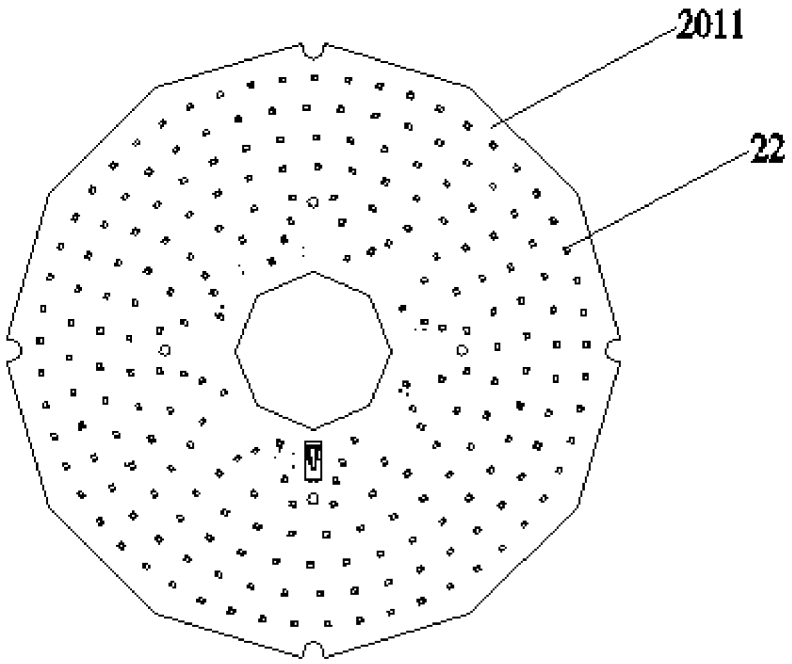
FIG. 3 and FIG. 4 are perspective views of a photoelectric module of the LED lamp in accordance with an embodiment with the insulation unit removed.
Figure 4:
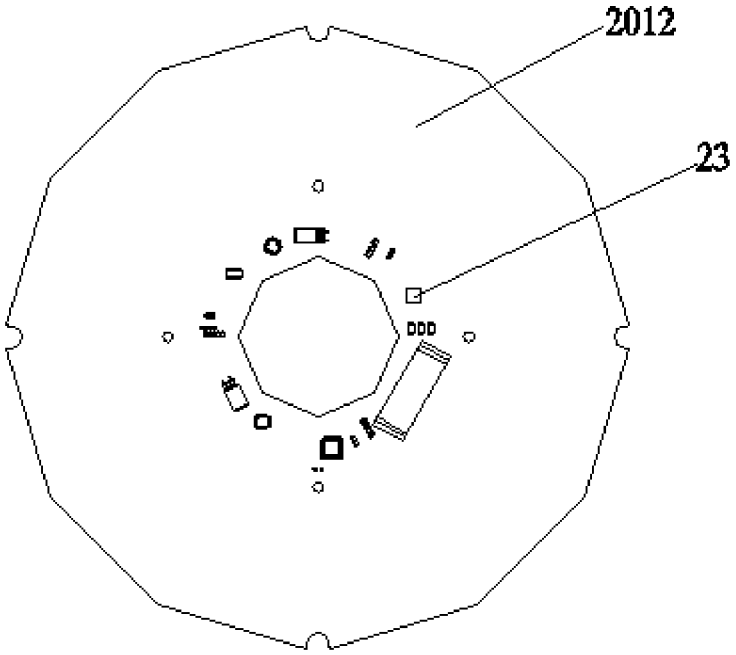
Figure 5:
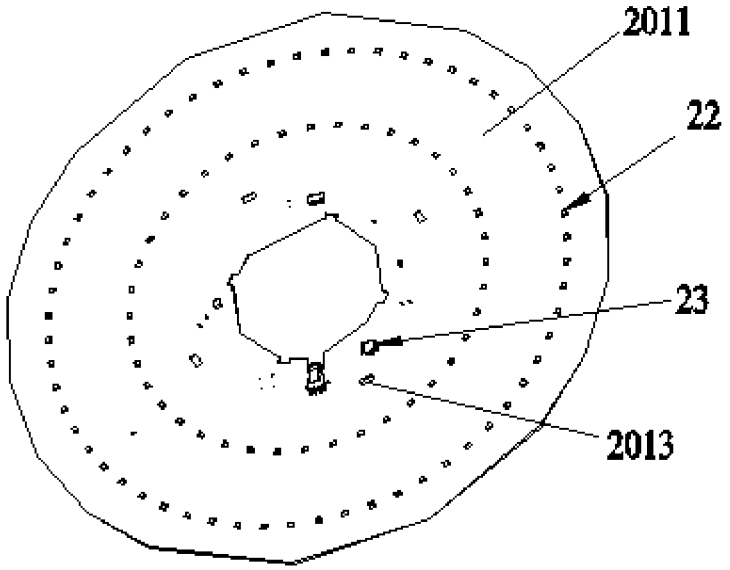
FIG. 5 and FIG. 6 are perspective views of the photoelectric module of the LED lamp in another embodiment with the insulation unit removed.
Figure 6:
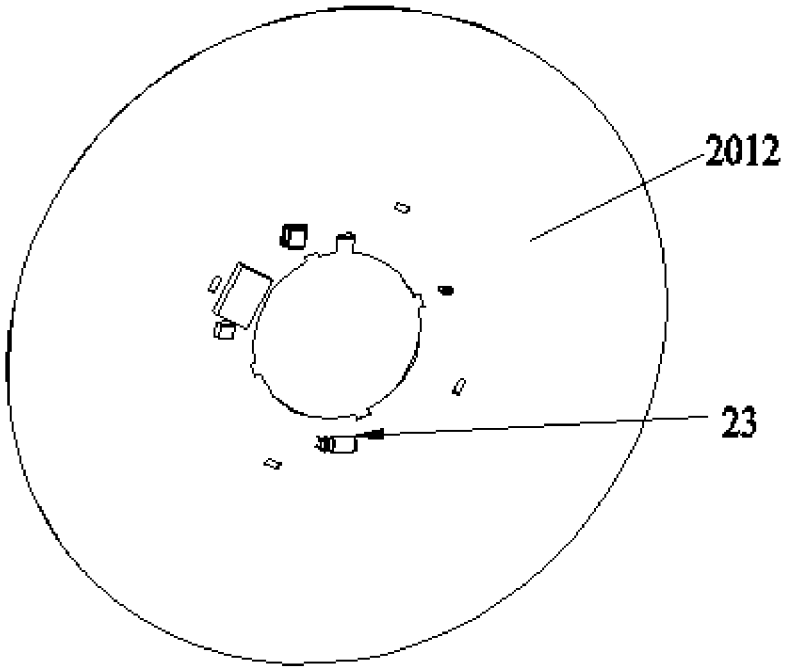
Figure 7:
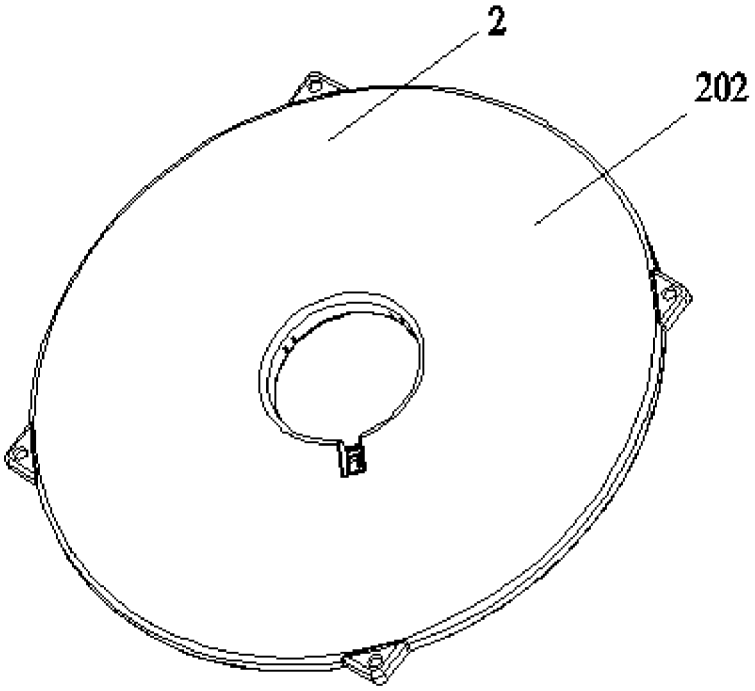
FIG. 7 and FIG. Bare perspective views of the photoelectric module of the LED lamp in an embodiment of the present disclosure.
Figure 8:
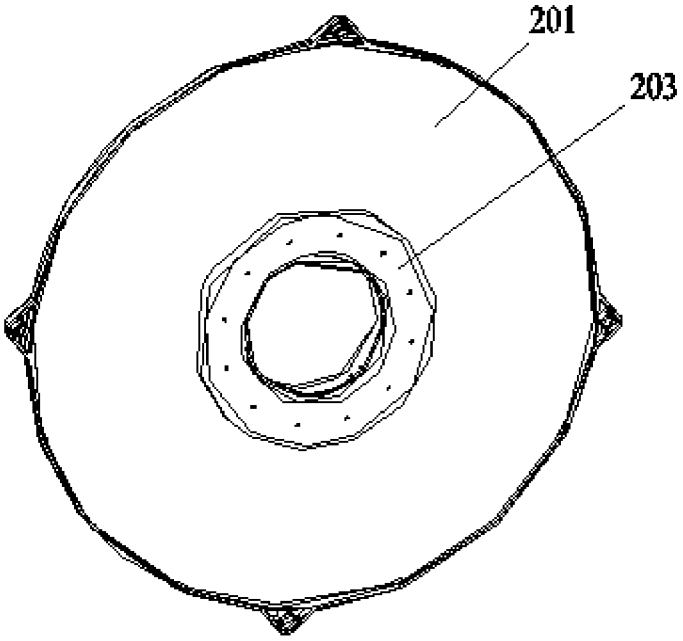
Figure 9:
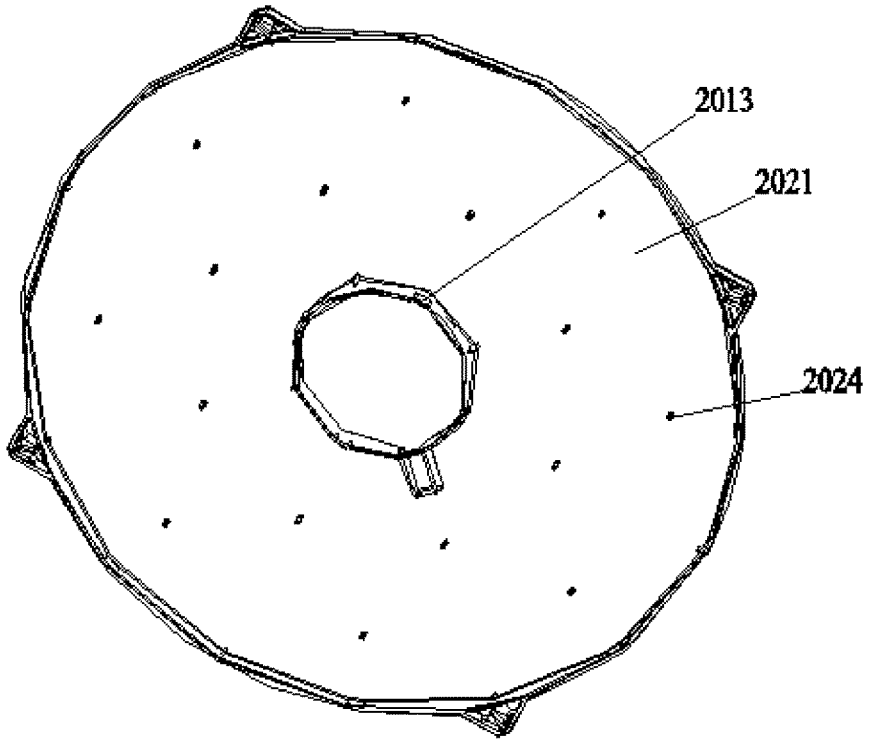
FIG. 9 is a perspective view of a first insulating portion of the photoelectric module of the LED lamp according to an embodiment of the present disclosure.

As shown in FIGS. 3 to 6, the circuit board 201 includes a first side 2011 and a second side 2012 disposed oppositely, wherein the first side 2011 is a side facing the lampshade 1. In some embodiments, the electronic components of the light source module 22 are disposed on the first side 2011, and the electronic components of the power supply module 23 can be all disposed on the first side 2011, whereby the circuit board 201 only needs to arrange the wiring layer on the first side 2011, such that the cost of wiring can be saved. Referring to FIGS. 3 and 4, in some embodiments, the electronic components of the light source module 22 are disposed on the first side 2011, and the electronic components of the power supply module 23 are all disposed on the second side 2012, whereby the electronic components in the light source module 22 and the electronic components in the power supply module 23 are disposed separately. When the lamp is illuminated, generally, the electronic components of the light source module 22 and the electronic components of the power supply module 23 may generate heat. Therefore, the electronic components of the light source module 22 and the electronic components of the power supply module 23 may be arranged separately, so that the heat source may be prevented from being concentrated or the heat generated during operation may influence each other. At this time, the circuit layer may be arranged on the first side 2011 and the second side 2012 at the same time.

In some embodiments, the electronic components in the light source module 22 are disposed on the first side 2011, the electronic components in the partial power supply module 23 are disposed on the first side 2011, and the electronic components in the other partial power supply module 23 are disposed on the second side 2012. In this embodiment, the electronic components of the power supply module 23 are disposed on the first side 2011 and the second side 2012, respectively, so that the electronic components in the power supply module 23 can be better arranged in a layout manner. For example, the electronic components of the power supply module 23 disposed on the first side 2011 include relatively low-height components, such as an IC (Integrated Circuit) and a surface mounted component (such as a chip fixed resistor). Therefore, light emitted from the light source module 22 is blocked by no obstacle, thereby the light loss can be reduced and the light emission efficiency can be improved at the same time. The electronic components of the power supply module 23 disposed on the second side 2012 include relatively high-height components, such as transformers, capacitors, inductors, and the like. For another example, electronic components of the power supply module 23 disposed on the first side 2011 includes a heat generating component (an IC, a resistor, or the like), and electronic components of the power supply module 23 disposed on the second side 2012 includes a heat-sensitive component (an electrolytic capacitor). The heat-sensitive component and the heat generating component are disposed on the first side 2011 and the second side 2012, respectively, so that the influence of the heat generated when the heat generating component is operating on the heat-sensitive component can be reduced, and the overall reliability and service life of the power supply module 23 can be improved.

As shown in FIGS. 7 to 12, the photoelectric module 2 further comprises an insulating unit including a first insulating portion 202 and a second insulating portion 203. The first insulating portion 202 is configured to be transparent to light generated when the light source module 22 is operated, and the first insulating portion 202 covers all the electronic components on the first side 2011 to prevent the electronic components on the first side 2011 from being unintendedly touched by human to cause electric shock. The second insulating portion 203 covers all the electronic components on the second side 2012, and the material of the second insulating portion 203 may be one of PC (Polycarbonate) or acrylic, and the two materials are light-weight and low-cost. In this embodiment, the electronic components on the second side 2012 are located on the radially more inner side of the circuit board 201 than any one of the electronic components of the light source modules 22, that is, the projection of the electronic components on the second side 2012 do not overlap the projection of the electronic components on the light source module 22 in the thickness direction of the circuit board 201. On the one hand, heat generated when the electronic components of the light source module 22 operate can be prevented from affecting the electronic components on the second side 2012, and on the other hand, the distribution area of the electronic components on the second side 2012 can be limited, thereby controlling the size of the second insulating portion 203 to control the cost.

The first insulating portion 202, in some embodiments, includes a cavity 2021 in which the circuit board 201 is disposed. The first insulating portion 202 has a side wall 2022, and the side wall 2022 is provided with a first limiting portion 2023, and the cavity 2021 of the first insulating portion 202 is provided with one or more second limiting portions 2024. When the circuit board 201 is loaded into the first insulating portion 202, both sides in the thickness direction of the circuit board 201 are limited by the first limiting portion 2023 and the second limiting portion 2024, respectively, that is, the circuit board 201 is sandwiched between the first limiting portion 2023 and the second limiting portion 2024, so as to be fixed. Moreover, the circuit board 201 is not easy to be shaken after installation. The first limiting portion 2023 may be a snap, and the second limiting portion 2024 may be a cylindrical body.

In this embodiment, a first fastening unit 2031 is provided on the second insulating portion 203, and a corresponding second fastening unit 2013 is provided on the circuit board 201. The first fastening unit 2031 is fastened to the second fastening unit 2013, thereby fixing the second insulating portion 203 to the circuit board 201. The first fastening unit 2031 may be a fastening portion, and the second fastening unit 2013 may be a fastening hole or a fastening portion. The second fastening unit 2013 may also be provided on the first insulating portion 202 so as to fix the second insulating portion 203 to the first insulating portion 202.

In some embodiments, the circuit board 201 and the first insulating portion 202 can be positioned with respect to each other by the concave-convex structure, thereby restricting the movement of the first insulating portion 202 with respect to the circuit board 201 in the horizontal direction (the direction parallel to the XY plane), that is, the circuit board 201 and the first insulating portion 202 are not displaced, so that no displacement occurs between the light source module 22 and the first insulating portion 202, whereby the reduction in the light extraction efficiency due to the displacement between the light source module 22 and the first insulating portion can be suppressed.

In some embodiments, the basic structure of the LED lamp is the same as that of the previous embodiments, and the LED lamp comprises a lampshade 1, a photoelectric module 2, and a base 3, which are not repeatedly described herein, except that this embodiment provides another form of fixing of the insulating unit to the circuit board. As shown in FIGS. 13 to 17, the power supply module 23 includes a first power supply module 231 (electronic components in the partial power supply module 23 disposed on the first side 2011 as described above) and a second power supply module 232 (electronic components in the partial power supply module 23 disposed on the second side 2012 as described above). The first power supply module 231 may be an SMT (surface mounting technology) component, and the second power supply module 232 may be a DIP (dual inline-pin package) component, for example, the DIP component includes an inductor, a capacitor, and the like. The first insulating portion 202 is provided with a first fastening member 25, and the first insulating portion 202 is fastened to the light source module 22 through the first fastening member 25. The second insulating portion 203 is provided with a second fastening member 26, and the second insulating portion 203 is fastened to the light source module 22 through the second fastening member 26 to provide insulation and mechanical protection for the power supply module 23. The power supply module 23 and the second insulating portion 203 are spaced apart so as to provide a stress buffer region for the second insulating portion 203, thereby preventing the second insulating portion 203 from damaging the power supply module when being impacted by an external force.

The first insulating portion 202 and/or the second insulating portion 203 may be provided with reinforcing ribs 27. By providing the reinforcing ribs, the impact strength of the first insulating portion 202 and/or the second insulating portion 203 may be increased, and the first insulating portion 202 and/or the second insulating portion 203 may be prevented from being damaged. The first insulating portion 202 and the second insulating portion 203 of the different structures may be combined with each other.

Figure 18:
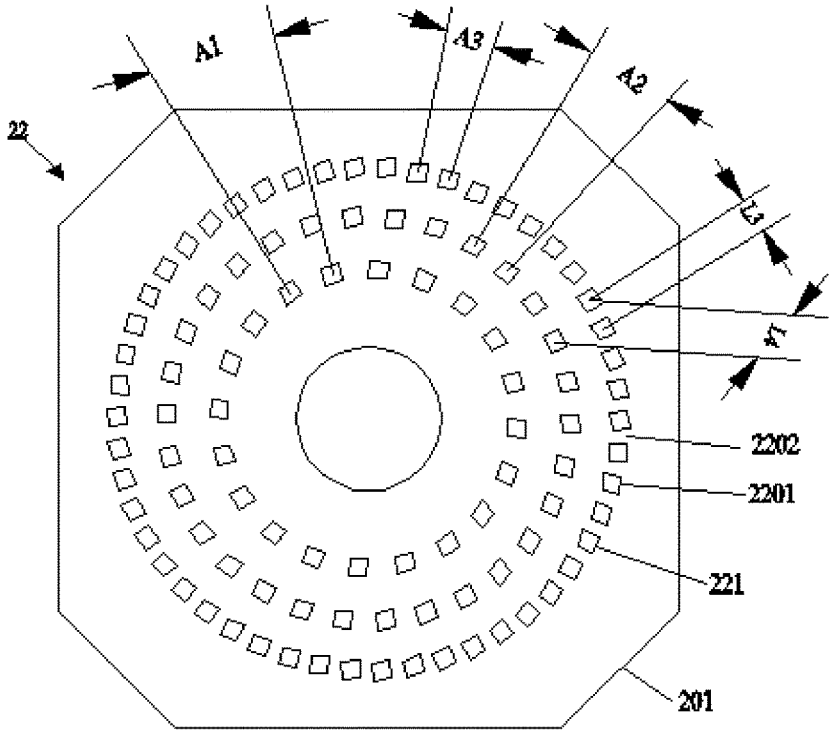
FIG. 18 is a schematic structural diagram of the photoelectric module of the LED lamp in an embodiment with the insulation unit removed.

As shown in FIG. 18, the circuit board 201 is provided with a plurality of LED chipsets 221, each of the plurality of LED chipsets 221 includes a plurality of LED chips 2201. Each of the plurality of LED chipsets is located on a circumference or substantially on a circumference, that is, the number of the LED chipsets is the same as the number of the circumference, the number of the circumference is set to be n ($n \geq 1$), and the pitch angle of the LED chips 2201 can be set to be $(90/n)°$. Any two LED chipsets have different light emission spectra, so that the brightness of the LED lamps is uniform and the color development of the LED lamps is improved. Of course, two or more LED chipsets can have the same light emission spectra, so that the LED lamps have a good light emission effect.

In some embodiments, the average distance between the LED chips 2201 is smaller than the distance between the first insulating portion 202 and the LED chips 2201, so that the luminance unevenness in the circumferential direction of the first insulating portion 202 can be reduced, thereby achieving more uniform luminance.

In some embodiments, in one of the plurality of LED chipset 221, the center distance of two adjacent LED chips 2201 is L3, and the center distance between any LED chip 2201 of one of the LED chipset 221 and a closest LED chip 2201 of the adjacent LED chip set 221 is L4, which corresponds to the following relationship: L3:L4 is 1:0.8~2, preferably L3:L4 is 1:1~1.5. As a result, the distribution of the LED chips 2201 is more uniform, so that the light output of the LED lamp is uniform.

As shown in FIG. 18, in this embodiment, the plurality of LED chipset 221 are disposed respectively on the inner ring, middle ring and outer ring, two adjacent LED chips 2201 form a center angle A1 with the axis of the LED lamp in the inner ring, and two adjacent LED chips 2201 form a center angle A2 with the axis of the LED lamp in the middle ring. The angle of the center angle A2 is smaller than the angle of the center angle A. In the outer ring, two adjacent LED chips 2201 form a center angle A3 with the axis of the LED lamp, and the angle of the center angle A3 is smaller than the angle of the center angle A2. The outer ring therefore has more LED chips 2201 than the middle ring, so that the pitch of the adjacent LED chips 2201 in the outer ring is not so much larger than the pitch of the adjacent LED chips 2201 in the middle ring, or even the pitch of the adjacent LED chips 2201 in the middle ring may be close to or equal to the pitch of the adjacent LED chips 2201 in the middle ring, and therefore, the arrangement of the LED chips 2201 may be more uniform, so that the light output from the LED lamp may be more uniform.

In other words, the LED chipsets 221 are provided on the circuit board 201 in a ring-shaped manner. The angle between the two adjacent LED chips 2201 of the relatively more inner LED chipsets 221 and the center angle formed by the axis of the LED lamp is larger than the angle between the two adjacent LED chips 2201 of the relatively more outer LED chipsets 221 and the center angle formed by the axis of the LED lamp. That is, the more outer LED chipset 221 has more LED chips 2201 than the more inner LED chipset 221, whereby the pitch of the two adjacent LED chips 2201 of the more outer LED chipset 221 is made closer to the pitch of the two adjacent LED chips 2201 of the relatively more inner LED chipset 221, so that the arrangement of the LED chips 2201 is more uniform so that the light emission is more uniform.

In some embodiments, the LED chipset 221 is provided with at least two groups, and the at least two groups of the LED chipsets 221 are sequentially arranged in the radial direction of the circuit board 201, and each group of LED chipsets 221 includes at least one LED chip 2201. Any one of the LED chips 2201 of one group of LED chipsets 221 in the radial direction of the circuit board 201 and any one of the LED chips 2201 of another group of LED chipsets 221 adjacent in the radial direction of the circuit board 201 are staggered in the radial direction of the circuit board 201. The LED chips 2201 of different LED chipsets 221 are located in different directions in the radial direction of the LED lamp, that is, any line starting from the axis of the LED lamp and extending from the radial direction of the LED lamp, for example, two or more LED chips 2201 are cut to different positions of the two or more LED chips 2201. That is, two or more LED chips 2201 are not cut to the same position.

Thus, assuming that the surface of the circuit board 201 has convection, when air flows in the radial direction of the circuit board 201, the contact between air and the LED chip 2201 is more sufficient in the flow path due to the relationship of the air flow paths, so that the heat dissipation effect is better. In addition, in terms of the light emitting effect, this arrangement of the LED chips 2201 facilitates uniformity of light emission.

In this embodiment, there is an open area 2202 between two adjacent LED chips 2201 in one of the plurality of LED chipset 221 to allow air flowing between the LED chips 2201, thereby carrying away heat generated when the LED chips 2201 are operated. And two groups of the LED chipsets 221 adjacent in the radial direction of the circuit board 201, wherein the open areas 2202 between any two adjacent LED chips 2201 in one group of the LED chipsets 221 and the open areas 2202 between any two adjacent LED chips 2201 in the other group of the LED chipsets 221 are staggered in the radial direction of the circuit board 201 and are connected with each other. Thus, assuming that the air flows in the radial direction of the circuit board 201, the contact between the air and the LED chip 2201 is more sufficient in the flow path due to the air flow path, so that the heat dissipation effect is better. If the open areas 2202 between any two adjacent LED chips 2201 in one group of the LED chipsets 221 and any two adjacent LED chips 2201 in the other group of the LED chipsets 221 of the circuit board 201 are in the same direction in the radial direction of the circuit board 201, air flows directly along the radial direction of the circuit board 201, and the contact between air and the LED chips 2201 is reduced in the flow path, thereby lowering the heat dissipation effect of the LED chips 2201.

For example, the LED chipset 221 is provided with three groups and is arranged in sequence in the radial direction of the circuit board 201, and corresponding open areas 2202 of any of the three groups of the LED chipsets are not in the same direction in the radial direction of the circuit board 201. As a result, the flow path of convection on the surface of the circuit board 201 is optimized, and the heat dissipation efficiency is improved.

In some embodiments, each LED chipset 221 includes only one light-colored LED chip 2201, so that the LED chips 2201 on each circumference can be staggered in the circumferential direction, and this arrangement has good color mixing property and light uniformity. Further, since the LED chips 2201 include an LED chip and a light conversion layer, and the light conversion layer includes a glue and a fluorescent powder. The LED chips on one circumference can emit white light, such as warm white light, daylight color light, and the like, and the LED chips on the circumference adjacent to the white light-emitting color can emit primary color light, such as red light, green light, blue light, and the like. The first insulating portion 202 is respectively provided with a first diffusing portion and a second diffusing portion corresponding to the circumference of white light-emitting color and primary light-emitting color, and the thickness of the first diffusing portion in the optical axis direction of the LED chips 2201 is smaller than that in the other direction except the optical axis direction of the LED chips 2201. The white light emitted from the LED chip is uniformly diffused by the first diffusing portion, the second diffusing portion has a uniform thickness, and the primary color light emitted from the LED chip is emitted through the second diffusing part in the same light distribution without diffusing, thereby adjusting the color-temperature contrast ratio on different circumferences to reproduce sky blue, and providing an appropriate illumination space according to a living scene.

In some embodiments, a lens may be disposed on the LED chip 2201. For example, the circuit board 201 is provided with three LED chipsets, which are respectively located on a first circumference, a second circumference and a third circumference with a same center and different radii. The LED chips 2201 on the first circumference and the second circumference are covered by the tubular lens, and each LED chip 2201 on the third circumference is covered by a single lens, so that the illuminance of the LED lamp is uniform.

In some embodiments, a part of the LED chipsets may be illuminated toward the central portion of the LED lamp, and another part of the LED chipsets may be illuminated toward the direction away from the circuit board 201 to prevent darkening of the central portion of the LED lamp.

In some embodiments, the circuit board 201 is provided with two groups of LED chipsets 221, the two groups of LED chipsets are arranged respectively on the circumference of two concentric centers and different radii, the first LED chipset is arranged on one circumference, and the second LED chipset is arranged on the other circumference. The first insulating portion 202 is provided with a first absorption region and a second absorption region corresponding to the first LED chipset and the second LED chip set, respectively. When the color temperature of the light-emitting color of the first LED chipset is less than the color temperature of the light-emitting color of the second LED chipset, the wavelength absorption amount of the first absorption region is greater than the wavelength absorption amount of the second absorption region, so that the color rendering property, the color temperature, and the color rendering deviation (DUV) of the lamp can be improved.

In some embodiments, the light source module 22 further comprises a lens unit covered on the circuit board 201 and is provided in a plurality of forms. Firstly, the circuit board 201 is provided with a plurality of LED chipsets, a night-light LEDs is provided between the adjacent two LED chipsets, the lens unit includes a lens main body covering the LED chipsets and a communication portion communicating with the adjacent lens main body and covering the night-light LEDs, and the light emitting surface of the lens main body may be set as a curved surface so that light emitted from the night-light LEDs is diffused toward the center and the outside of the LED lamp, and uniform irradiation can be realized. Secondly, the lens unit has two ridges between which a night-light LEDs is provided, which serves as a point light source with opposite directionality and functions as a light distribution. Thirdly, the lens unit may be provided with protrusions so that light emitted from the LED chips 2201 on the circuit board 201 is diffused and emitted mainly in the radial direction with the circuit board 201 as an origin, thereby suppressing the occurrence of particle sensation when the light source module 22 is illuminated. Fourthly, the circuit board 201 is provided with a plurality of LED chipsets, the number of the lens units is greater than 2, an avoidance portion is provided between the two lens units, the circuit board 201 is provided with holes, the LED chipsets are disposed around the holes, and the avoidance portion is provided with recesses facing the holes to prevent the first insulating portion 202 from optically interfering with each other. Fifthly, the lens unit has a storage recess portion aligned with the LED chip 2201 to receive the LED chip 2201, the lens unit has an incident surface and an opposing projection surface, the diffusivity in the region comprising the projection surface adjacent to the optical axis of the LED chip 2201 and the incident surface is set to be higher than the diffusivity in the other region, the luminance distribution of the lampshade 1 becomes smooth, and the light transmission efficiency is high. Sixthly, the lens unit has a first surface and a second surface, the first surface is a light incident surface close to the side of the LED chip 2201, the second surface is a surface through which light incident by the LED chip 2201 from the first surface is transmitted to the outside. The first surface includes a light control surface for distributing light emitted from the LED chip 2201 at a large angle, and a plurality of convex portions or a plurality of concave portions disposed around the light control surface. The light control surface is diffused by the plurality of convex portions or the concave portions, so that the generation of bright lines on the lampshade 1 can be suppressed. Seventhly, the lens unit includes a plurality of lenses, each of which covers each of the LED chips 2201, that is, the number of the lenses is equal to the number of the LED chips 2201. The first insulating portion 202 has a lens cover having a light-transmitting property, and the lens cover emits light of the LED chips 2201 toward the central portion of the LED lamp, so that the distribution peak angle of the lenses can be set, thereby improving the uniformity of illumination. Eighthly, the lens unit includes a concave portion for light incident from the LED chip 2201, and an LED accommodating portion for accommodating the LED chip to prevent the LED chip from coming into contact with the concave portion, and the LED accommodating portion and the concave portion are smoothly continuous with each other by a convex curved surface protruding from the LED chip. Ninthly, the lens unit includes a first light distribution region having a first outer surface and a second light distribution region having a second outer surface, the first outer surface reflecting light inwardly in the optical axis direction of the LED chip 2201, and the second outer surface reflecting light outwardly in the optical axis direction of the LED chip 2201. By adjusting the position of the LED chip, it is possible to avoid generating glare by suppressing a portion of the illuminance. Further, the arrangement of the LED chips 2201 according to the second to ninth embodiments of the lens unit may be the arrangement in the above embodiments, or may be another arrangement.

In some embodiments, the circuit board 201 may also take other different forms. For example, the circuit board 201 may include a plurality of sub-circuit boards, which may be arranged in a plurality of different configurations. In some embodiments, at least one of the sub-circuit boards has a certain angle of inclination with respect to the base 3. In some embodiments, any one of the plurality of sub-circuit boards has an inner region in which the LED chip 2201 is not placed, and an outer region in which the LED chip 2201 is placed. The spacing between the LED chips 2201 close to the inner region is small, and the spacing between the LED chips 2201 far from the inner region is large, so that the LED lamp can be uniformly illuminated.

In one embodiment, the sub-circuit boards are arranged in a circumferential direction, and each sub-circuit board is provided with an LED chip 2201 of different emitting colors. The emitting colors of the LED chips 2201 closest to each other are different. The distance between the adjacent LED chips 2201 in one of the plurality of sub-circuit boards is equal to the shortest distance between the LED chips 2201 of the adjacent sub-circuit boards, respectively. By arranging the LED chips 2201 of different emitting colors, the light emitting surfaces can be uniformly emitted. In some embodiments, two adjacent sub-circuit boards are connected by a connecting portion, and a protruding portion of one sub-circuit board is accommodated in a receiving portion of the adjacent sub-circuit board. Light emitted from the LED chip 2201 is easily diffused in a direction orthogonal to the extending direction of the LED chip 2201, thereby preventing the center of the connecting portion from darkening, thereby preventing the light emitting surface of the LED lamp from generating uneven brightness. In some embodiments, the circuit board 201 is composed of two sub-circuit boards, and the first insulating portion 202 is provided with a reflecting portion, and the reflecting portion has a first reflecting surface for obliquely emitting light emitted from the LED chip 2201 on one sub-circuit board from the lower vertical direction, and a second reflecting surface for reflecting light emitted from the LED chip 2201 on the other sub-circuit board toward the center of the lamp, so as to suppress luminance unevenness on the first insulating portion.

In some embodiments, the circuit board 201 may also take other different forms, for example, the circuit board 201 includes an inner side region provided with the power supply module 23 and an outer side region provided with the light source module 22, a plurality of first blocks and a plurality of second blocks alternately arranged in an adjacent manner to each other in the outer side region. The average value of the distances from the plurality of LED chips 2201 arranged in the first blocks to the center of the circuit board 201 is larger than the average value of the distances from the plurality of LED chips 2201 arranged in the second blocks to the center of the circuit board 201, so that the light emitted from the LED chips 2201 arranged in the first region located at a position remote from the center of the circuit board 201 is prevented from being blocked by the second insulating portion 203 of the power supply module arranged in the inner side region, and the uniform luminance of the light emitting surface of the lamp shade can be ensured.

Figure 19:
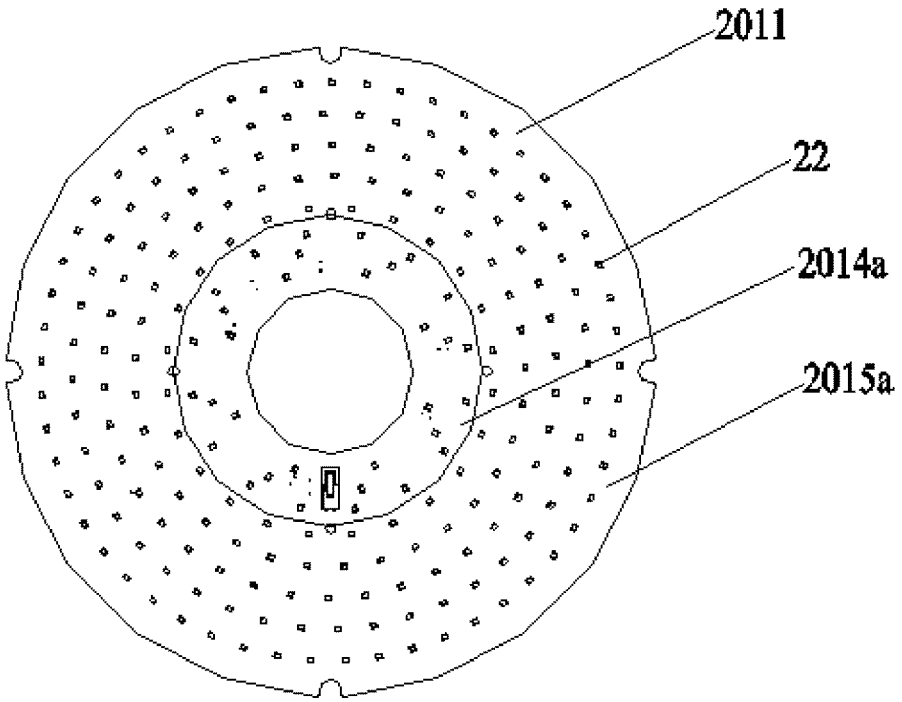
FIG. 19 and FIG. 20 are schematic diagrams of a configuration of the photoelectric module of the LED lamp in an embodiment with the insulating unit removed.
Figure 20:
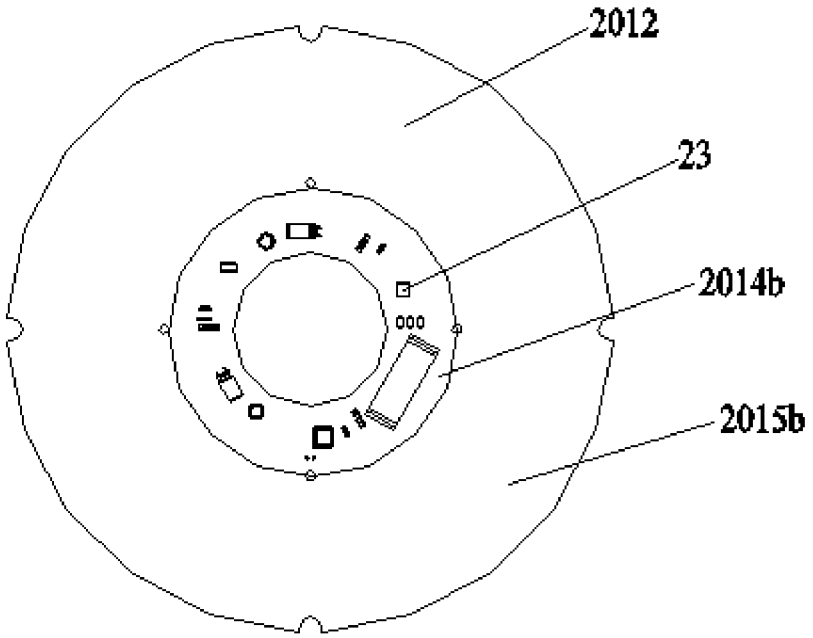

In some embodiments, the circuit board 201 may also take other different forms. As shown in FIGS. 19 and 20, the second side 2012 of the circuit board 201 includes a third region 2014*b* for the power supply module 23 to be disposed thereon and a fourth region 2015*b* without the power supply module 23. The first side 2011 includes a first region 2014*a* opposite to the third region 2014*b* and a second region 2015*a* opposite to the fourth region 2015*b*. The number of LED chips 2201 located in the first region 2014*a* is less than the number of LED chips 2201 located in the second region 2015*a*. In this way, on the one hand, the dark area in the middle of the LED lamp is significantly reduced, and the luminous effect of the LED lamp is improved. On the other hand, the influence of heat generated by the power supply module 23 on the light source module 22 can be reduced.

In some embodiments, the third region 2014*b* is close to the central axis of the LED lamp, and the fourth region 2015*b* is far away from the central axis of the LED lamp (compared to the third region 2014*b*). Since the power supply module 23 is disposed close to the center of the LED lamp, the amplitude of the external force applied to the photoelectric module 2 is small during transportation, and the power supply module 23 is not damaged by the external force.

Figure 21:
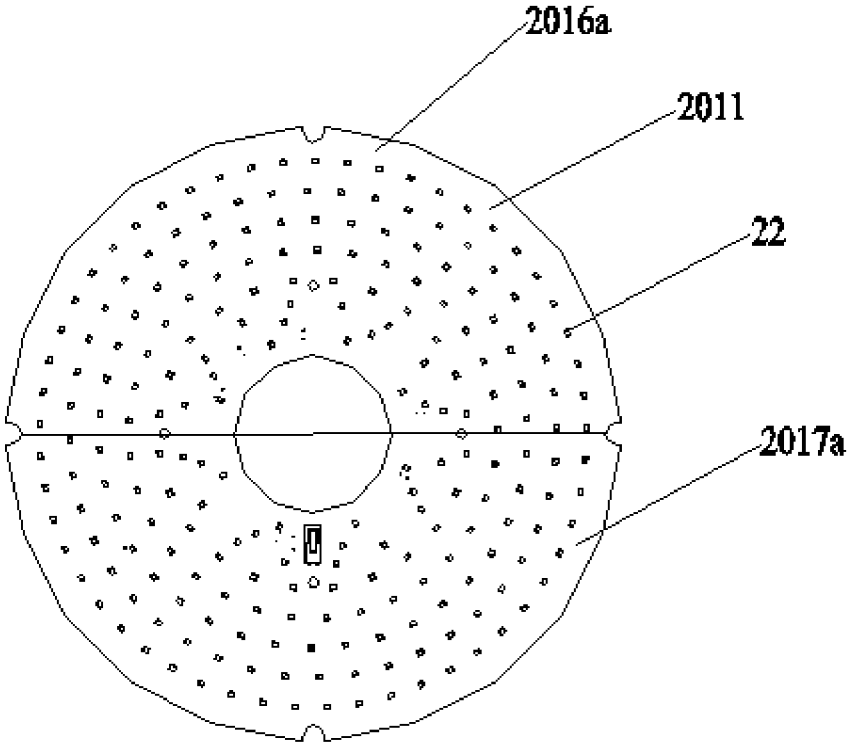
FIG. 21 and FIG. 22 are schematic diagrams of the photoelectric module of the LED lamp in another embodiment with the insulation unit removed.
Figure 22:
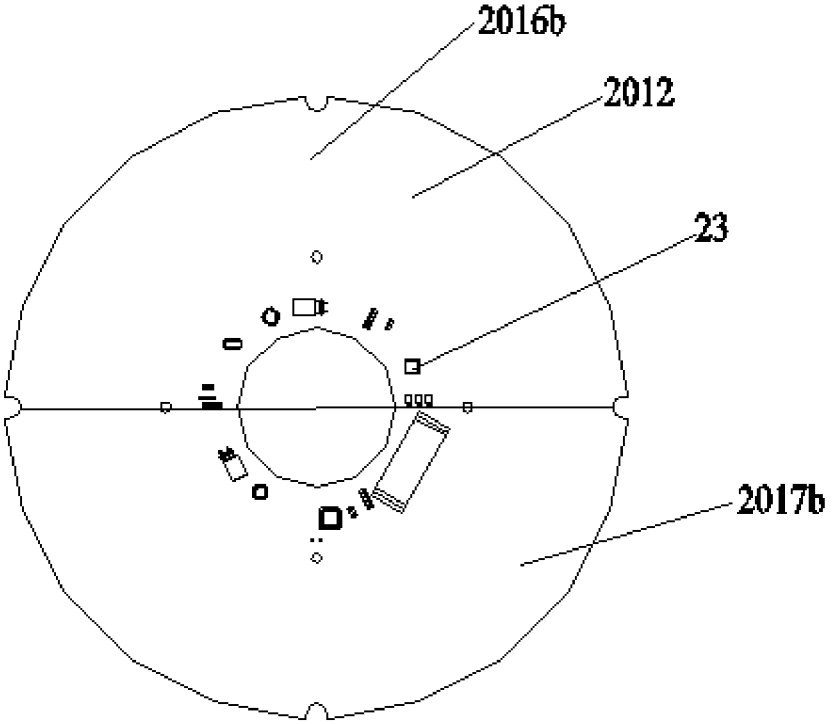

In some embodiments, the circuit board 201 may also take other different forms. As shown in FIGS. 21 and 22, the second side 2012 of the circuit board 201 includes a seventh region 2016*b* and an eighth region 2017*b*, the electronic components of the power supply module 23 include a heat generating component (a component that generates more heat during operation, such as an IC, a resistor, and the like) and a heat-sensitive component (a component that is liable to change the working capacity due to heat, such as an electrolytic capacitor). The heat generating component and the heat-sensitive component are located in the seventh region 2016*b* and the eighth region 2017*b*, respectively, so that the influence of the heat generated during operation of the heat generating component on the heat-sensitive component can be reduced, the overall reliability and life of the power supply module 23 can be improved. The first side 2011 includes a fifth region 2016*a* opposite to the seventh region 2016*b* and a sixth region 2017*a* opposite to the eighth region 2017*b*, and the number of LED chips 2201 located in the fifth region 2016*a* is less than the number of LED chips 2201 located in the sixth region 2017*b*, thereby reducing the influence of the heat generated by the power supply module 23 on the light source module 22.

In some embodiments, the circuit board 201 may take other different forms. In order to improve the heat dissipation efficiency of the light source module 22, the circuit board 201 includes an inner region provided with the power supply module 23 and an outer region provided with the light source module 22, and a fragile portion (slit or slot) is provided between the inner region and the outer region, so that the location of the fragile portion is flexible, thereby improving the adhesion between the circuit board 201 and the base 3, and increasing the heat dissipation area.

In some embodiments, the circuit board 201 may also take other different forms. The photoelectric module 2 includes a night-light LEDs, and the circuit board 201 includes a first area for configuring the night-light LEDs and a second area for configuring the LED chips 2201. The first area is close to the central axis of the LED lamp, and a slit is formed between the night-light LEDs and the LED chips 2201 to ensure an insulating distance between the night-light LEDs and the LED chip, and prevent short circuits due to a potential difference between the night-light LEDs and the LED chips 2201.

In some embodiments, the circuit board 201 may also take other different forms, for example, the circuit board 201 is provided with an optical member for controlling the light distribution of the light emitted from the LED chip 2201. The optical member has a dome-shaped incident surface, an exit surface, and a dielectric portion between the incident surface and the exit surface. The ratio of the distance r of the LED chip 2201 from the incident surface in the optical axis direction to the distance d of the LED chip 2201 from the incident surface in the outer periphery direction is $r/d<1$, and the corresponding light space can be generated according to the living scene by adjusting the r and the d.

Figure 10:
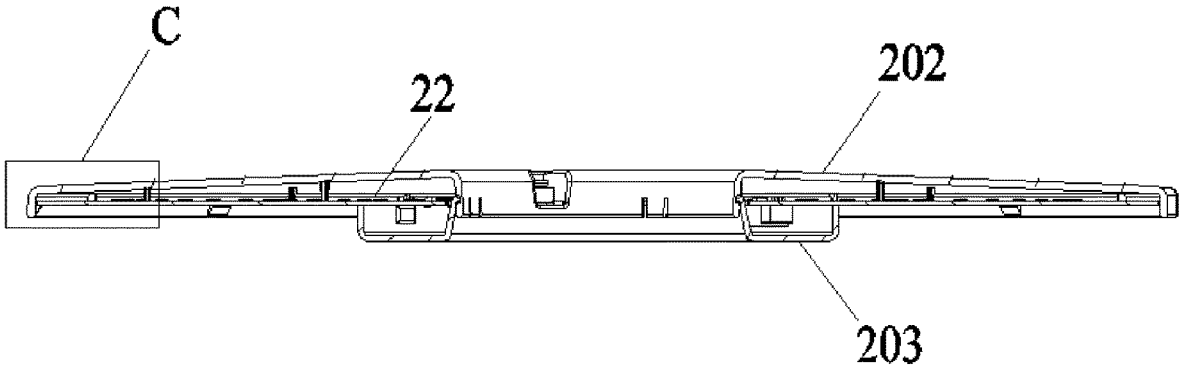
FIG. 10 is a schematic cross-sectional view of the photoelectric module of the LED lamp in an embodiment of the present disclosure.
Figure 11:
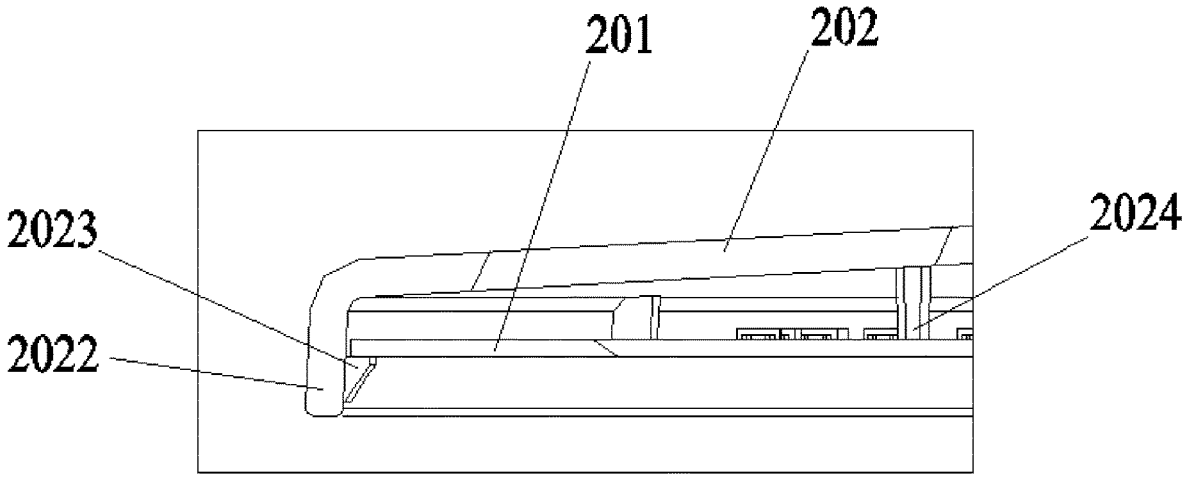
FIG. 11 is an enlarged view at C shown in FIG. 10.

As shown in FIGS. 10 and 11, the first insulating portion 202 has a certain arc from the center to the edge of the light source module 22 in the radial direction of the light source module 22, or the first insulating portion 202 has a certain arc from one end of the light source module 22 in the radial direction of the light source module 22 to the other end of the light source module 22, and the arc corresponds to a circle center angle of 2° to 50°, preferably 5° to 15°. The first insulating portion 202 is designed to have an arc degree, so that the strength of the force applied to the first insulating portion 202 during transportation can be increased, thereby protecting the integrity of the photoelectric module 2, and the inclination of the first insulating portion 202 with respect to the circuit board 201 can be relaxed, so that light rays can be softly distributed. In other embodiments, the first insulating portion 202 includes a transparent substrate adjacent to the circuit board 201, and a light diffusion layer with light transmittance. A decorative layer forming a predetermined pattern is provided between the transparent substrate and the light diffusion layer, and light transmitted through the decorative layer is not scattered by the light diffusion layer. Therefore, when the LED lamp is viewed from the floor side, a clearly defined pattern can be seen, so that the illumination effect can be enhanced.

Figure 12:
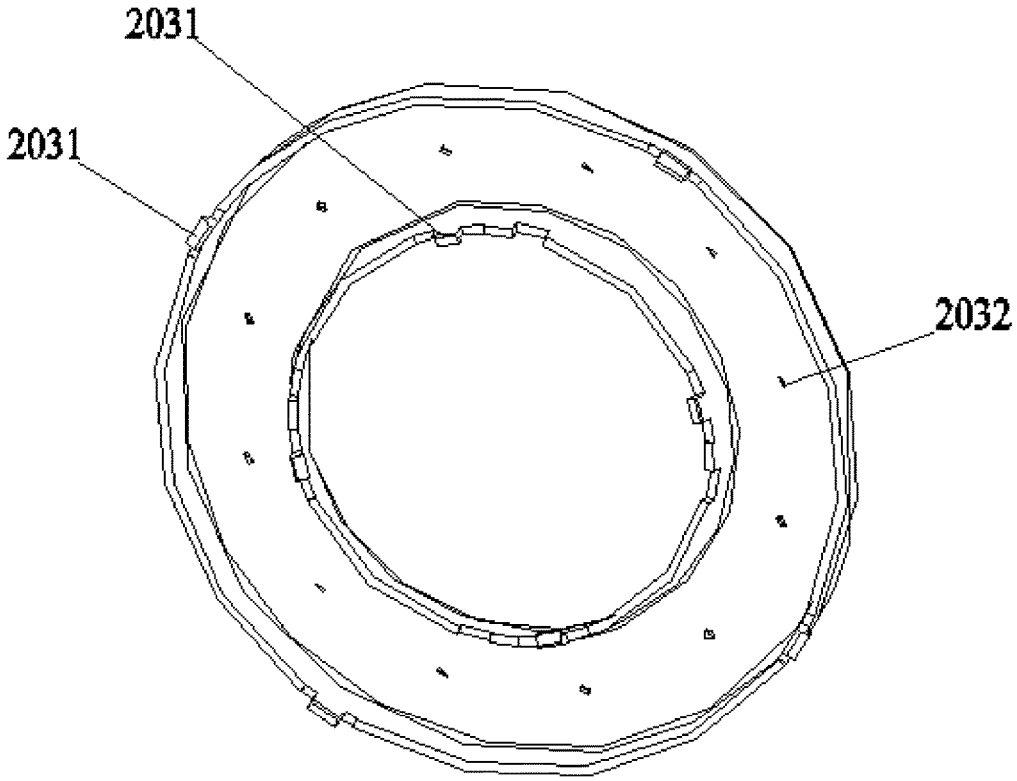
FIG. 12 is a perspective view of a second insulating portion of the photoelectric module of the LED lamp according to an embodiment of the present disclosure.
Figure 13:
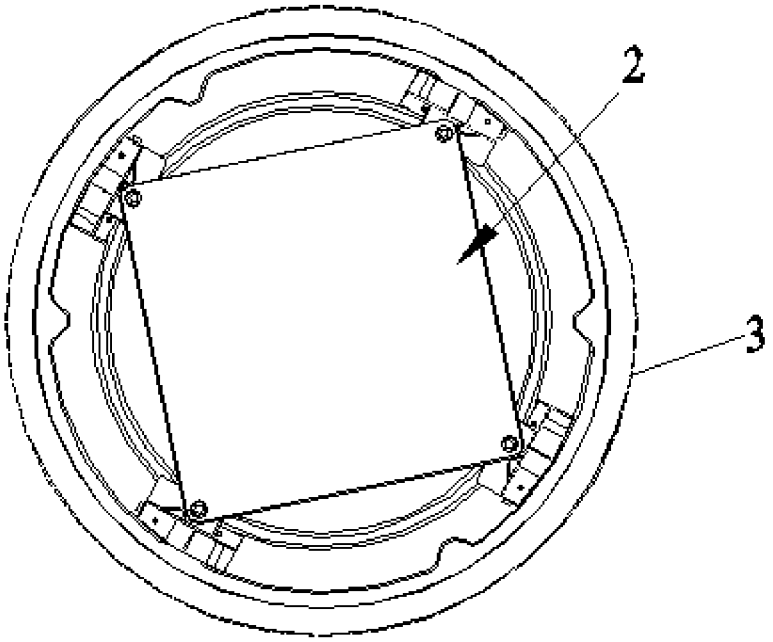
FIG. 13 is a schematic view of the LED lamp in an embodiment with the lampshade removed.
Figure 14:
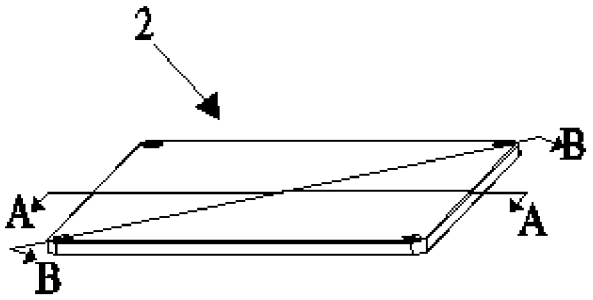
FIG. 14 and FIG. 15 are schematic structural diagrams of the photoelectric module of the LED lamp according to an embodiment of the present disclosure.
Figure 15:
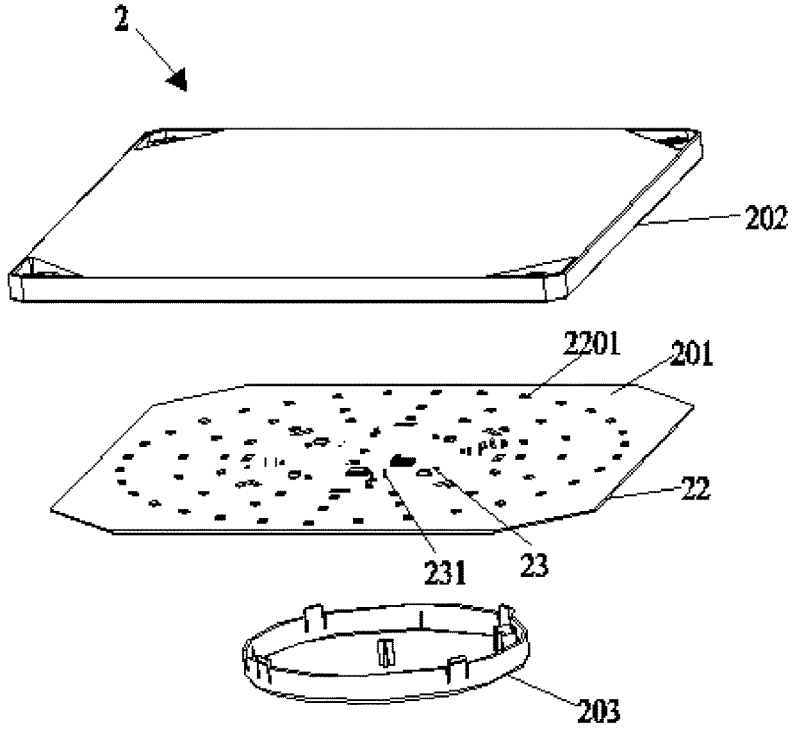
Figure 16:
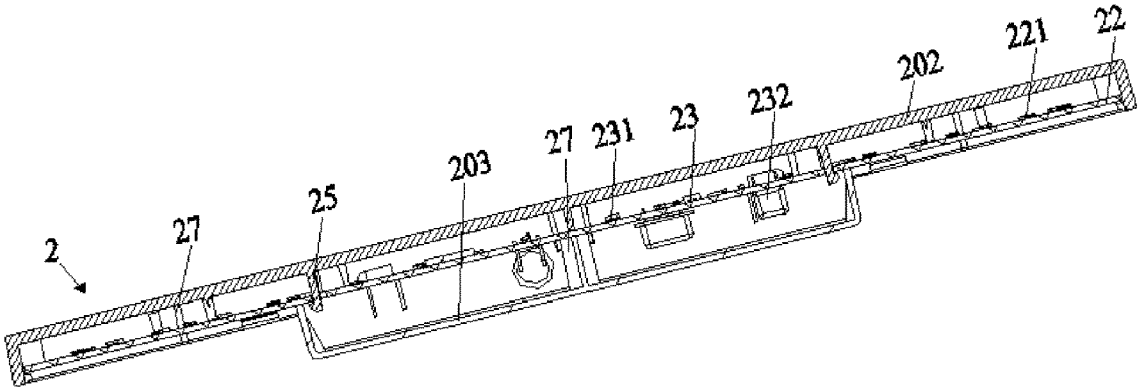
FIG. 16 is a schematic structural diagram of a section A-A shown in FIG. 14.
Figure 17:
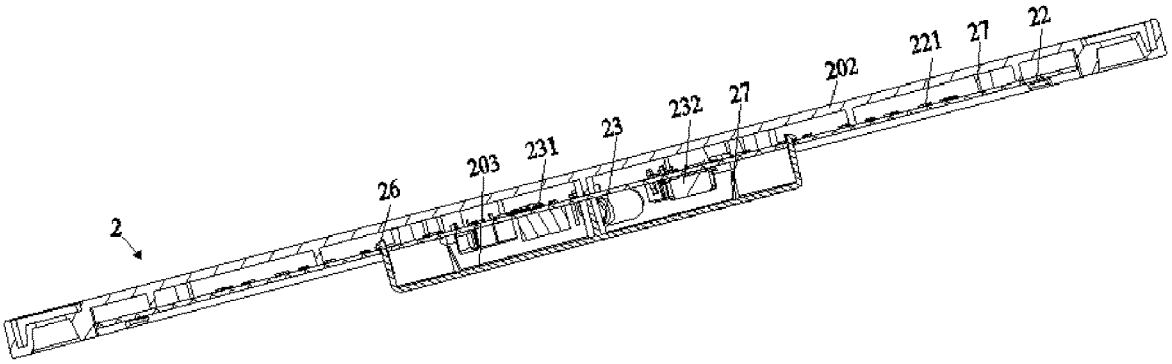
FIG. 17 is a schematic structural diagram of a section B-B shown in FIG. 14.

As shown in FIGS. 10 to 12, a plurality of first holes 2032 are provided in the second insulating portion 203, and a space for accommodating an electronic component is formed between the second insulating portion 203 and the circuit board 201. The arrangement of the first holes 2032 facilitates the formation of air convection in the space in which the electronic components are accommodated, whereby at least a portion of the heat generated when the electronic components are operated is discharged through the first holes 2032, thereby enhancing the heat dissipation effect of the electronic components.

In some embodiments, the second insulating portion 203 may take other different forms, and the second insulating portion 203 may be composed of a plurality of blocks having overlapping regions therebetween, the distance from the overlapping regions to the base 3 being smaller than the distance from other portions (other than the overlapping regions) of the second insulating portion 203 to the base 3, so as to prevent the second insulating portion from contacting the power supply module 23, increase the heat dissipation path, and improve the heat dissipation effect.

In some embodiments, the first insulating portion 202 may take other different forms. The first insulating portion 202 includes a central region and an end region, the central region being adjacent to the central axis of the LED lamp, the end region being remote from the central axis of the LED lamp, and the end region being provided with a light-directing reflective portion for directing light emitted from the light source module 22 from the central region to the end region to increase the illumination range of the LED lamp.

In some embodiments, the first insulating portion 202 may take other different forms, the first insulating portion 202 having an inner region, an outer region, and an intermediate region between the inner region and the outer region, the inner region being adjacent to the central axis of the LED lamp, the inner region having a first thick portion is thicker than the intermediate region, the first thick portion being capable of providing a lens effect so that the central portion of the lamp is bright and light loss is small.

In some embodiments, the first insulating portion 202 may take other different forms, and the first insulating portion 202 may have a plurality of prisms on its surface. Each prism has a first prism surface and a second prism surface that are inclined at different angles with respect to the circuit board 201. Light emitted from the LED chip is refracted to the first prism surface and the second prism surface, so that the discomfort caused by glare can be suppressed.

In some embodiments, the first insulating portion 202 may take other different forms. The first insulating portion 202 has a high-transmittance light-transmitting portion and a low-transmittance lens portion. The light-transmitting portion surrounds the lens portion and is remote from the central axis of the LED lamp, so that the illuminance of the lamp can be uniform and the light output rate of the lamp is high. In some embodiments, the first insulating portion 202 is provided with a lens, so that the radial and circumferential light distribution of the first insulating portion can be controlled, the circumferential brightness of the LED lamp is suppressed, and the radial light distribution is ensured.

In some embodiments, the first insulating portion 202 may take other different forms. The photoelectric module 2 includes a night-light LEDs provided on the circumference closest to the central axis of the LED lamp, and a mask capable of transmitting a pattern is provided on the night-light LEDs, so that the luminous efficiency of the lamp can be ensured and the light design can be improved. In addition, when the night-light LEDs is turned on, bright lines may be generated on the lampshade 1. To prevent this phenomenon, a diffusion cover is provided outside the night-light LEDs for diffusion, and the first insulating portion 202 covers an area of the night-light LEDs and the light source module 22 as a uniform surface without a concavo-convex surface, so that no bright line is generated.

Figure 23:
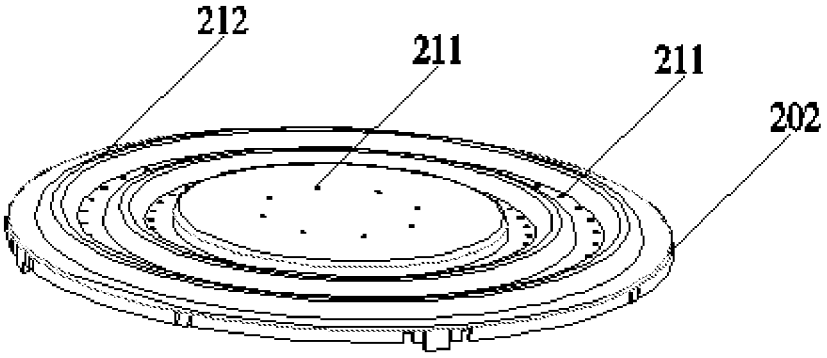
FIG. 23 is a schematic structural diagram of a first insulating portion of the LED lamp according to an embodiment of the present disclosure.
Figure 24:
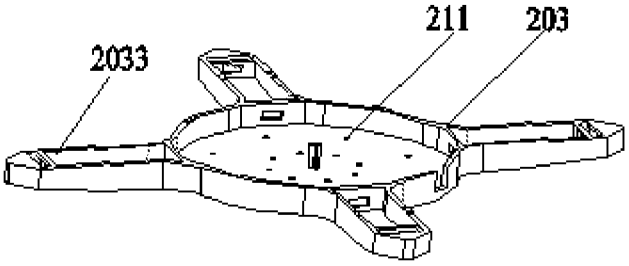
FIG. 24 is a schematic structural diagram of a second insulating portion of the LED lamp according to an embodiment of the present disclosure.

In some embodiments, the first insulating portion 202 and the second insulating portion 203 may take other different forms. As shown in FIGS. 23 and 24, in this embodiment, the first insulating portion 202 is provided with a lens group 212 that corresponds to the LED chipset 221, that is, the lens group 212 is located above the LED chipset 221 so that the light distribution is more dispersed and uniform. The lens group 212 is molded at one time by an injection molding process, and the production cost is reduced by installing the lens separately. The first insulating portion 202 is provided with a plurality of heat dissipation hole groups, and the heat dissipation hole groups include a plurality of heat dissipation holes 211, wherein at least one of the heat dissipation hole groups is close to the LED chip group 221, so that heat generated from the circuit board 201 is rapidly dissipated, and the heat dissipation effect is greatly increased. The second insulating portion 203 may be provided with a heat dissipation hole 211 to further reduce the temperature of the power supply module 23 and improve the service life of the lamp. The second insulating portion 203 may be provided with a plurality of auxiliary portions 2033, and the plurality of auxiliary portions 2033 are circumferentially distributed. Alternatively, when the insulating unit is fixed to the circuit board 201, the auxiliary portions may increase the connection strength between the insulating unit and the circuit board 201. In addition, the heat dissipation area of the second insulating portion 203 may be increased to improve the heat dissipation effect. In some embodiments, the heat dissipation hole 211 may be provided in the middle of the first insulating portion 202, and a plurality of spaced-apart notches may be provided at the outer edge of the first insulating portion 202, so that air can flow between the circuit board 201 and the first insulating portion 202, thereby improving the heat radiation effect.

Figure 25:
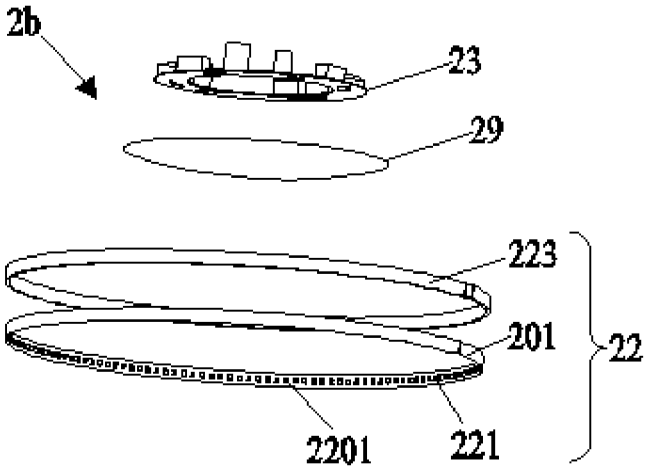
FIG. 25 is a schematic structural diagram of a photoelectric module of the LED lamp according to an embodiment of the present disclosure.
Figure 26:
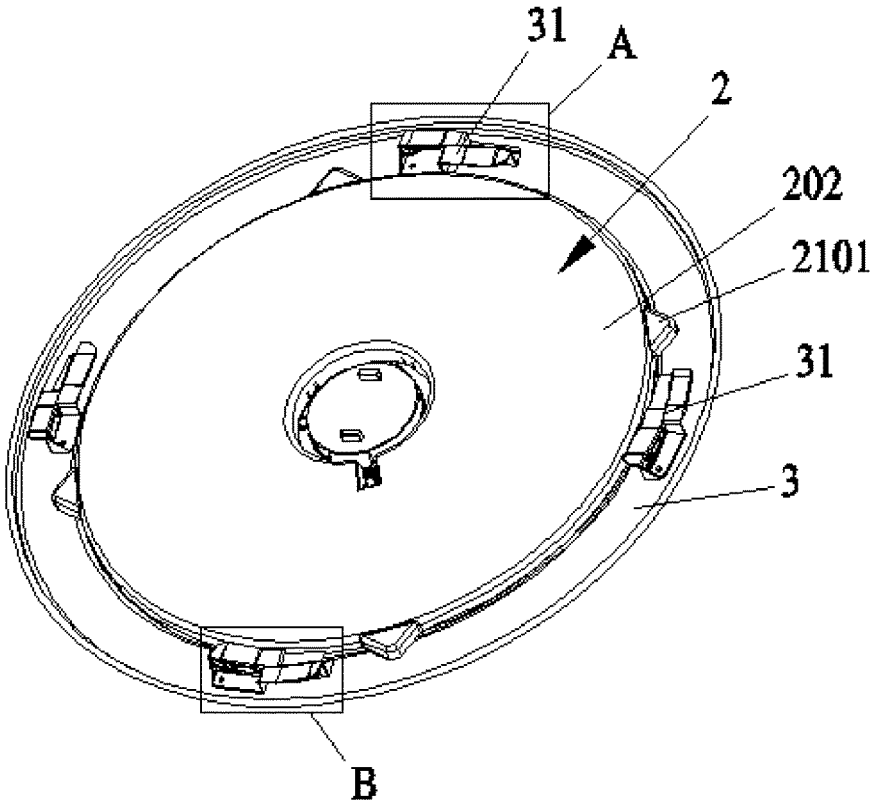
FIG. 26 is a perspective view of the LED lamp in an embodiment with the lampshade removed.
Figure 27:
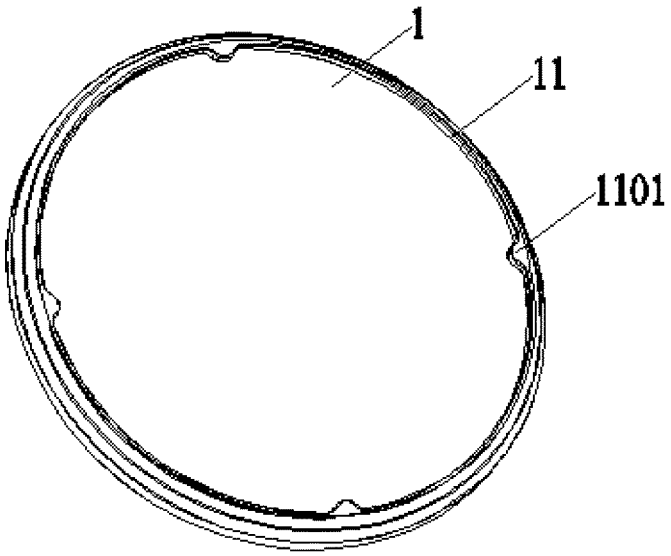
FIG. 27 is a perspective view of the lampshade in an embodiment of the present disclosure.
Figure 28:
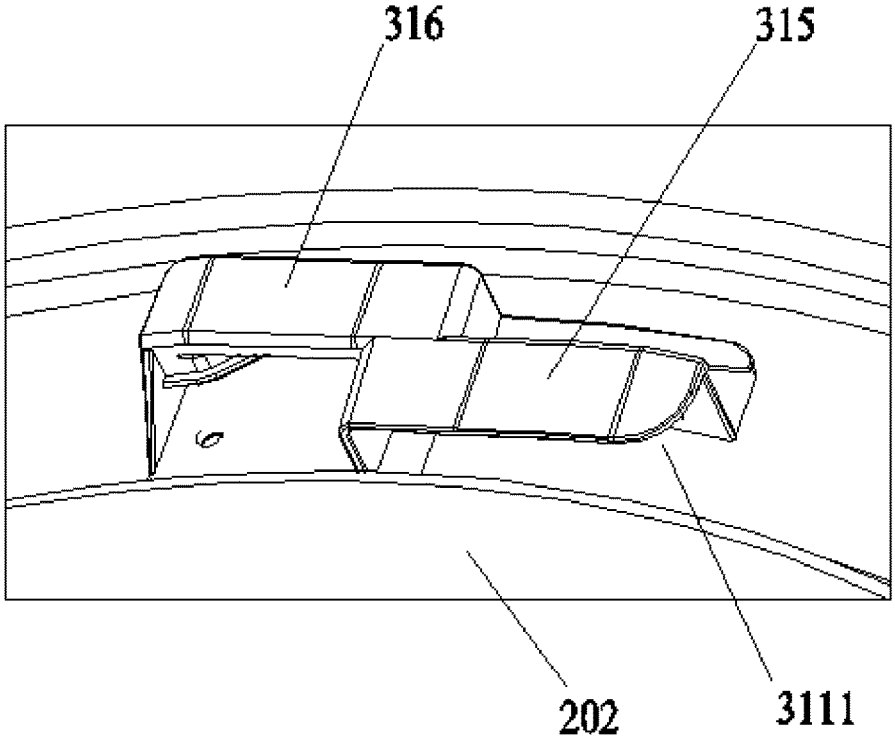
FIG. 28 is an enlarged view at A shown in FIG. 26.
Figure 29:
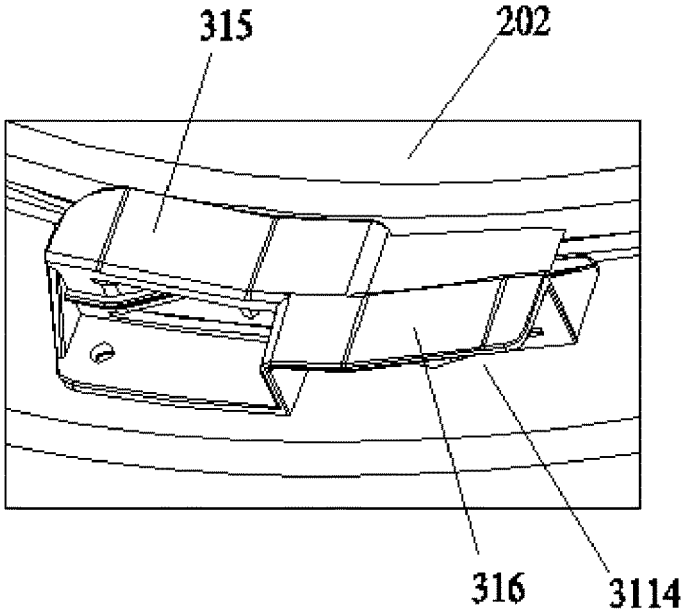
FIG. 29 is an enlarged view at B shown in FIG. 26.
Figure 30:
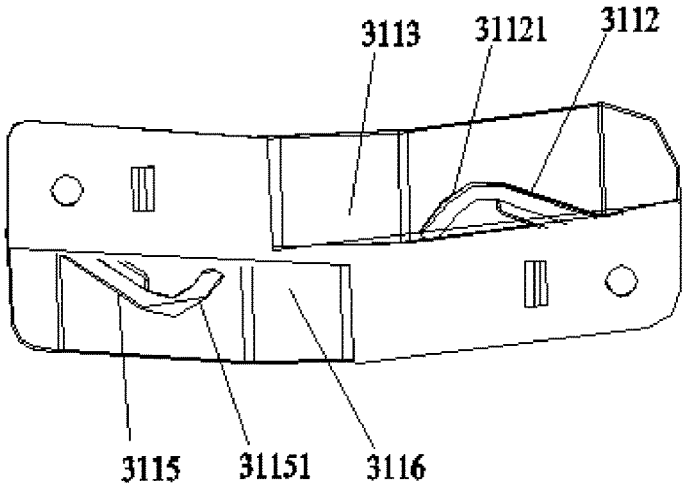
FIG. 30 is a front view of the mounting portion according to an embodiment of the present disclosure.
Figure 31:
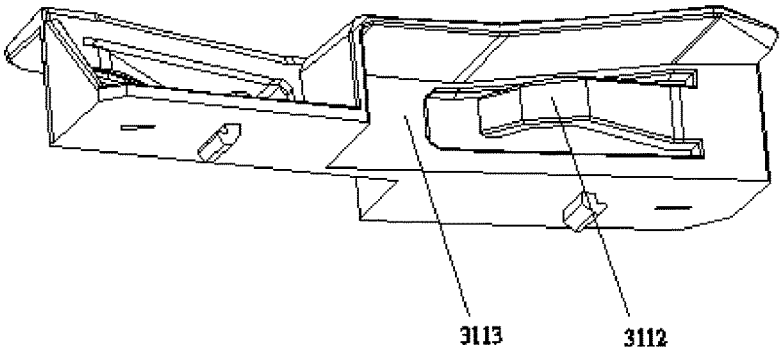
FIG. 31 and FIG. 32 are perspective views of a mounting portion according to an embodiment of the present disclosure.
Figure 32:
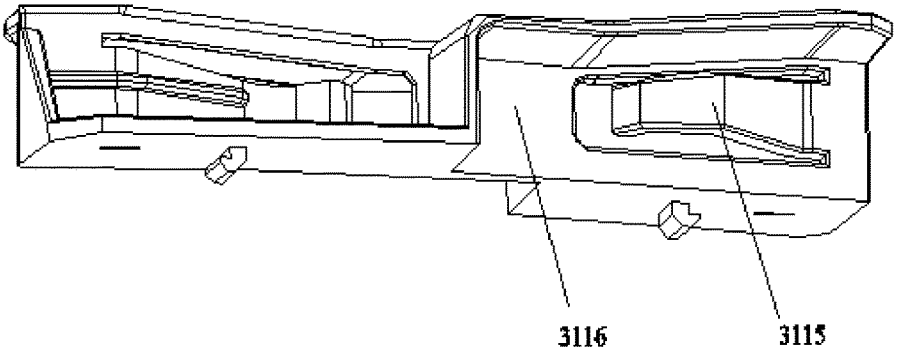

FIG. 25 is a schematic structural diagram of another embodiment of the photoelectric module 2*b*. As shown in FIG. 25, the photoelectric module 2*b* includes a light source module 22 and a power supply module 23. A reflective member 29 is provided between the light source module 22 and the power supply module 23. The LED light source module 22 surrounds the reflective member 29. The light source module 22 includes a circuit board 201 and at least one group of LED chipsets 221 located on the circuit board 201. Each of the LED chipsets 221 includes a plurality of LED chips 2201. The light emitting surface of the LED chips 2201 faces the central axis of the LED lamp, so that an intermediate dark area can be effectively eliminated, and a light emitting effect of the LED lamp can be improved.

Figure 46:
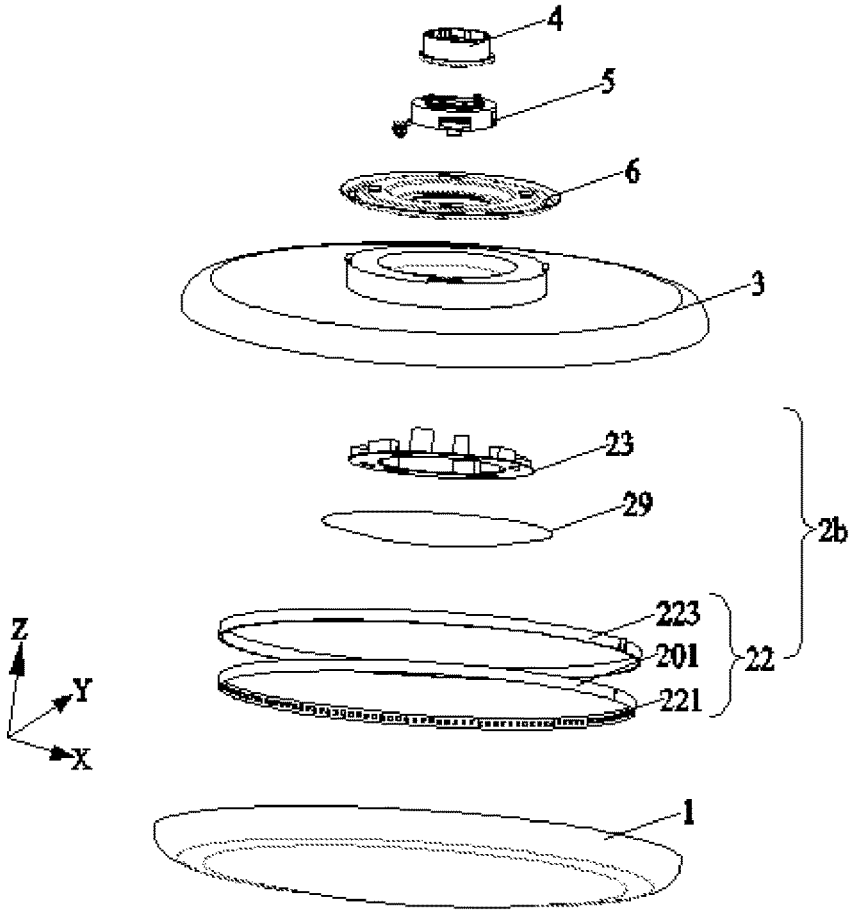
FIG. 46 and FIG. 47 are perspective views of the LED lamp according to an embodiment of the present disclosure.

Referring to FIG. 46, a part of the light emitted from the LED chip 2201 is reflected by the reflective member 29 and then emitted from the lampshade 1. In some embodiments, the outer surface of the LED chip 2201 may be isolated from the external environment through a colloid (e.g., silica gel) to avoid the risk of electrical shock. Alternatively, an adhesive layer of uniform thickness is applied to the entire circuit board 201.

In this embodiment, the LED light source module 22 further includes a heat dissipating member 223. The heat dissipating member 223 may be an aluminum ring, a copper ring, or the like. The circuit board 201 is attached to the heat dissipating member 223. To improve the heat dissipating effect, a heat dissipating rib (not shown) may be provided on the surface of the heat dissipating member 223 far away from the circuit board 201 to increase the heat dissipating area. The heat dissipating rib and the circuit board 201 are located on two opposite surfaces of the heat dissipating member 223, respectively.

In this embodiment, the LED light source module 22 can be prepared using the following method:

1) Inserting the pad terminal of the circuit board 201 into a slot of a turntable, and the turntable is activated, and the circuit board 201 is attracted around the slot of the turntable;

2) Aligning a dispensing head with the circuit board 201, the rotation of the turntable starts dispensing, and the turntable stops rotating after dispensing;

3) Snapping the heat dissipating member 223 into the slot of the turntable, and the turntable rotates once to cut off the heat dissipating member 223 and take out the heat dissipating member 223 and the circuit board 201; and 4) Attaching the LED chip 2201 to the circuit board 201 to form the LED light source module 22.

The preparation method is simple to operate, low in equipment cost, and capable of effectively improving production efficiency and reducing production cost.

As shown in FIGS. 26 to 32, the outer edge of the first insulating portion 202 is provided with a first protruding portion 2101, and the first protruding portion 2101 protrudes from the outer edge of the first insulating portion 202. In this embodiment, the first insulating portion 202 may be provided in a rotating structure, and the first protruding portion 2101 may be provided in a plurality of outer edges of the first insulating portion 202 along the circumferential direction of the first insulating portion 202. In this embodiment, a mounting portion 31 is provided on the base 3, and the mounting portion 31 provides mounting of the first protruding portion 2101. Specifically, the mounting portion 31 comprises a first mounting portion 315, and the first mounting portion 315 has a first clamping groove 3111. The first insulating portion 202 has a fixing position in which the first protruding portion 2101 is engaged with the first clamping groove 3111 and a releasing position in which the first protruding portion 2101 is separated from the first clamping groove 3111. In this embodiment, the first insulating portion 202 is switched between the fixed position and the relaxed position in the form of a rotation, approximately about the axis of the LED lamp. In this embodiment, both sides of the first clamping groove 3111 in the axial direction of the LED lamp are closed by the first mounting portion 315 and the base 3. Therefore, after the first protruding portion 2101 is clamped into the first clamping groove 3111, the first protruding portion 2101 is limited in both sides in the thickness direction of the LED lamp. In other embodiments, both sides of the first clamping groove 3111 in the axial direction of the LED lamp are closed by the structure of the first mounting portion 315 itself to achieve the same function as described above.

In some embodiments, the first mounting portion 315 has a positioning unit for positioning the first protruding portion 2101 engaged in the first clamping groove 3111. Specifically, the positioning unit includes a first elastic arm 3112 and a first groove 3113 formed between the first elastic arm 3112 and the first mounting portion 315. In the fixed position, the first protruding portion 2101 is engaged in the first groove 3113 at the end portion of the LED lamp in the radial direction, so as to fix the positioning of the first insulating portion 202. A first blocking portion 31121 is formed on the first elastic arm 3112. By the arrangement of the first elastic arm 3112, when the first protruding portion 2101 needs to be disengaged from the first clamping groove 3111 to rotate the first insulating portion 202, it is necessary to overcome the obstruction of the first blocking portion 31121 (that is, the first insulating portion 202 needs to be forced so that the first protruding portion 2101 presses the first elastic arm 3112 so that the first elastic arm 3112 is released), thereby preventing the first insulating portion 202 from being released from the first clamping groove 3111 due to misoperation, collision, or the like. In this embodiment, in the fixed position, the first elastic arm 3112 can be pressed against the first protruding portion 2101 to further tighten the first insulating portion 202. The first elastic arm 3112 may be integrally formed in the first mounting portion 315. The first elastic arm 3112 may be a sheet-like structure having elasticity with its own material properties, such as plastic or metal, which may be of a material having elasticity in the prior art. The first blocking portion 31121 may be formed directly by bending (or providing bending at the first elastic arm 3112) of the first elastic arm 3112.

In some embodiments, the first mounting portion 315 and the second mounting portion 316 are an integral member, and the first clamping groove 3111 and the second clamping groove 3114 are located on opposite sides of the integral member, respectively. In other embodiments, the first mounting portion 315 and the second mounting portion 316 may be formed in a split structure (not shown).

Figure 2:
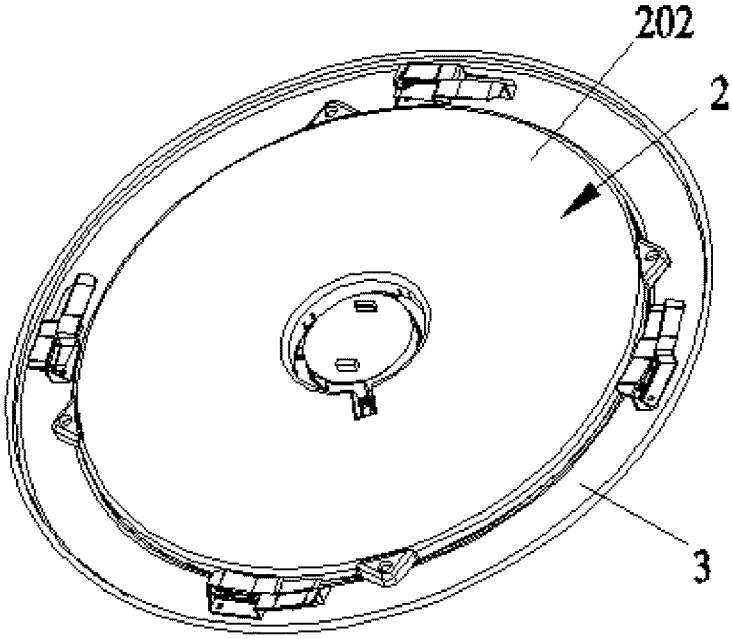
FIG. 2 is a schematic diagram of an embodiment of FIG. 1 with the lampshade removed.
Figure 33:
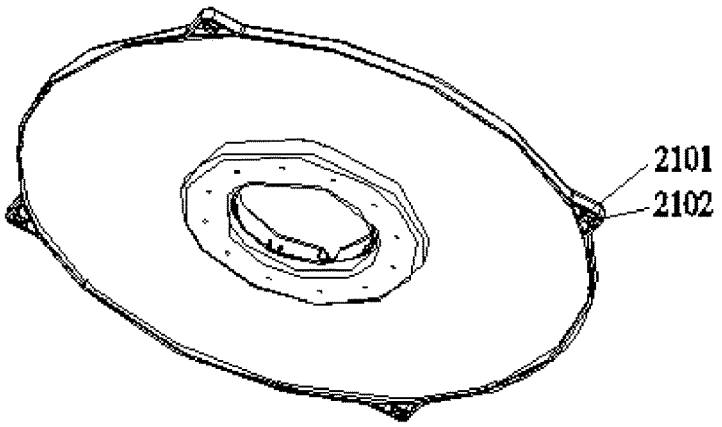
FIG. 33 is a perspective view of a photoelectric module of the LED lamp according to an embodiment of the present disclosure.
Figure 34:
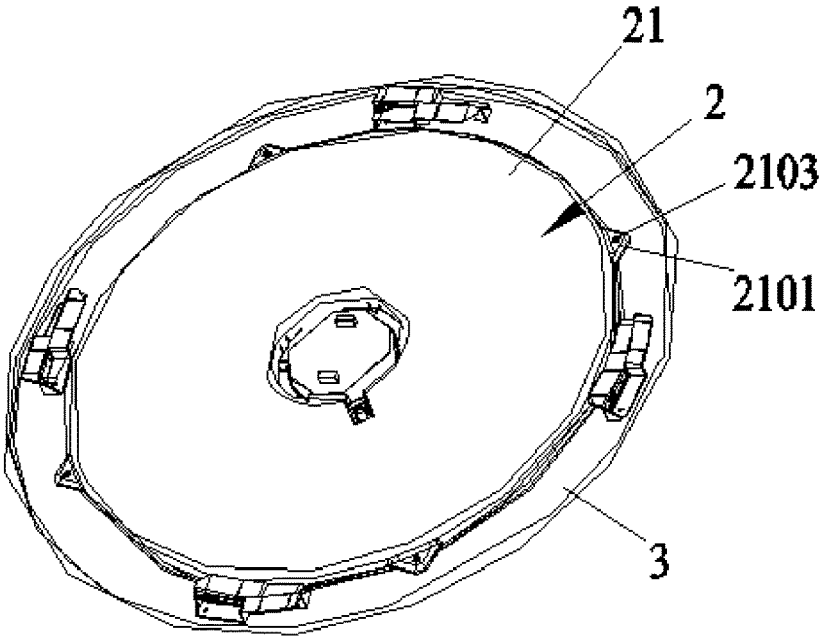
FIG. 34 is a perspective view of the LED lamp in an embodiment with the lampshade removed.

The photoelectric module 2 may also be connected to the base 3 in other configurations. As shown in FIGS. 2 and 33, in some embodiments, the photoelectric module 2 is fixed to the base 3 by means of a magnetic connection (in this embodiment, other basic structures are the same as in the previous embodiments). Specifically, the first insulating portion 202 of the photoelectric module 2 has a first protruding portion 2101 on which a magnet 2102 is provided, and the base 3 includes a part or a part made of iron. Therefore, the first protruding portion 2101 can be directly attracted to the base 3 by the magnet 2102 for fixing. In other embodiments, the magnets may be provided in different positions, for example, on the light source module 22, the power supply module 23, or the second insulating portion 203, and details are not described herein. As shown in FIG. 34, the photoelectric module 2 may also be attached to the base 3 in a threaded manner (in this embodiment, other basic structures are the same as those in the previous embodiment). Specifically, the first insulating portion 202 of the photoelectric module 2 has a first protruding portion 2101 on which a bolt 2103 is provided, and the bolt 2103 is connected to the base 3, thereby completing the fixing of the photoelectric module 2. In other embodiments, the bolts may be provided in different positions, such as on the light source module 22, the power supply module 23, or the second insulating portion 203, and details are not described herein.

Figure 35:
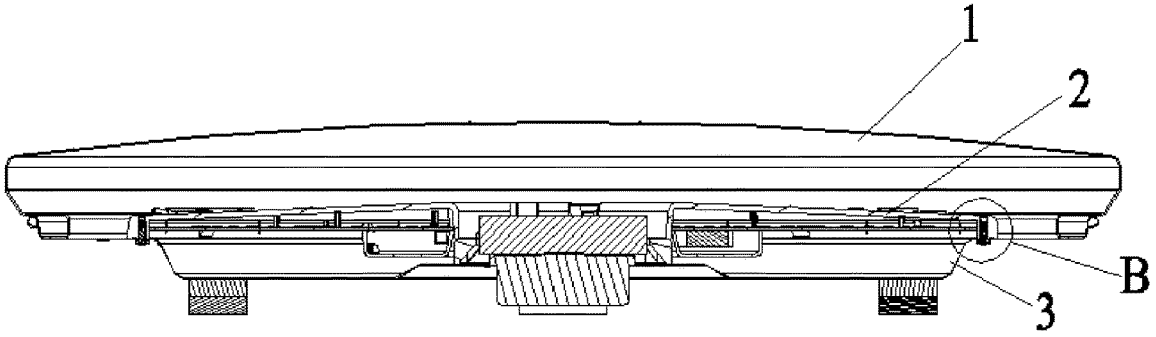
FIG. 35 is a schematic cross-sectional view of the LED lamp according to an embodiment of the present disclosure.
Figure 36:
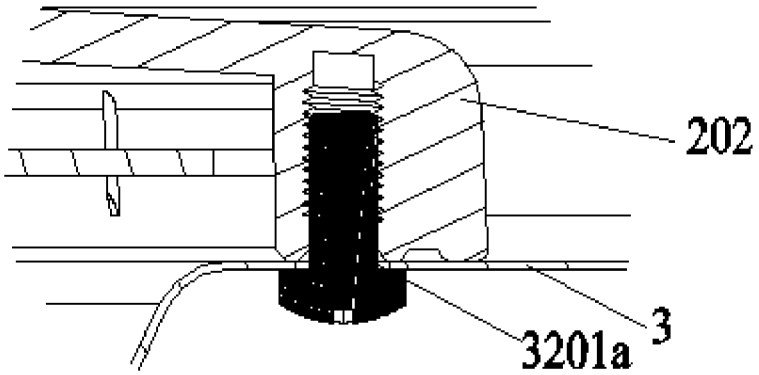
FIG. 36 is an enlarged view at B shown in FIG. 35.
Figure 37:
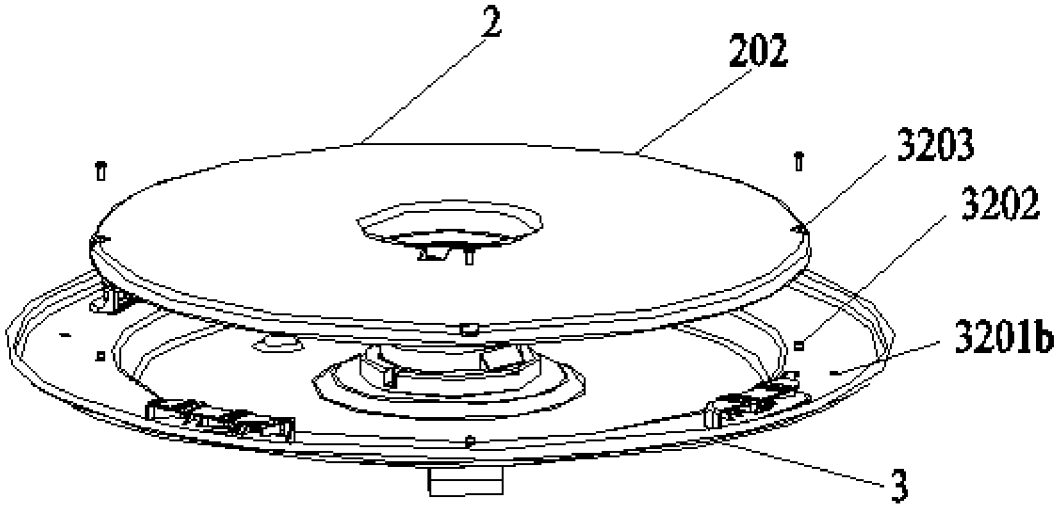
FIG. 37 and FIG. 38 are perspective views of the LED lamp in an embodiment with the lampshade removed.

As shown in FIGS. 35 and 36, in some embodiments, the photoelectric module 2 may also be attached to the base 3 by other screw fastening means, the base 3 is provided with a plurality of through-holes 3201*a*, the through-holes 3201*a* may be located on a circumference, and the first insulating portion 202 of the photoelectric module 2 is provided with a screw hole through which a screw passes to the screw hole, thereby fixing the photoelectric module 2 to the base 3. In some embodiments, as shown in FIG. 37, the base 3 is provided with a plurality of through-holes 3201*b*, which may be located on a circumference, in which a stud 3202 is placed so that the stud 3202 is press-riveted on the base 3, and the first insulating portion 202 of the photoelectric module 2 is provided with a screw hole 3203 through which a screw is passed to the stud 3202, thereby fixing the photoelectric module 2 to the base 3.

Figure 38:
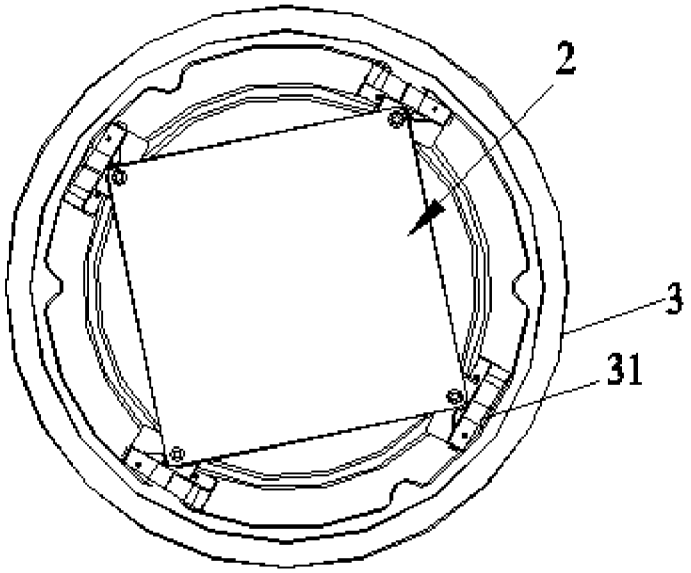
Figure 39:
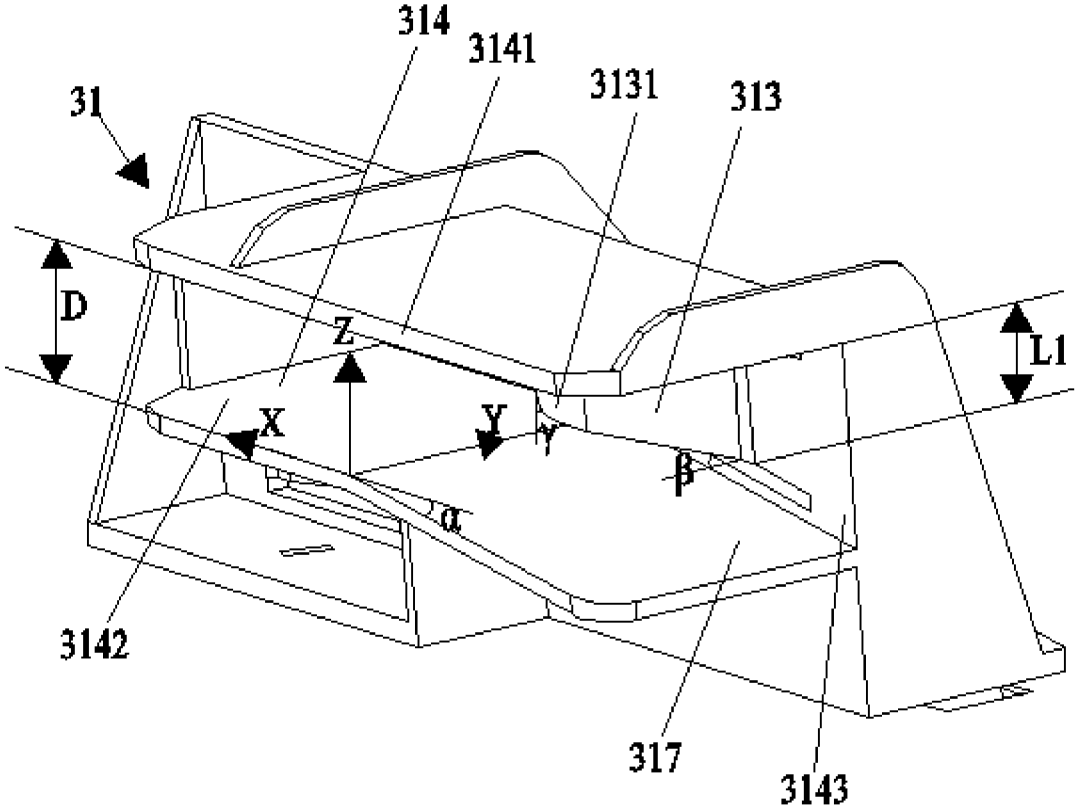
FIG. 39 is a perspective view of a mounting portion according to an embodiment of the present disclosure.

The basic structure of the LED lamp shown in FIG. 38 is the same as that of the LED lamp (ceiling lamp) of the previous embodiments, except that the photoelectric module 2 and the base 3 are specifically fixed. Specifically, as shown in FIGS. 38 and 39, the base 3 is provided with a mounting portion 31, the mounting portion 31 includes a fixing portion 314 and an inclined portion 317 connected to the fixing portion 314. The fixing portion 314 includes an upper limit portion 3141, a lower limit portion 3142 provided opposite to the upper limit portion 3141, the lower limit portion 3142 is connected to the inclined portion 317. A connecting portion 3143 is provided between the upper limit portion 3141 and the lower limit portion 3142, the connecting portion 3143 is connected to a positioning portion 313 positioned opposite to the inclined portion 317. A part of the corner of the photoelectric module 2 is slid into the lower limit portion 3142 along the inclined portion 317 and then held in a fixed state by the positioning portion 313, and the surface of the upper limit portion 3141 contacts a part of the surface of the photoelectric module 2.

The space position of the mounting portion 31 is located in the Cartesian coordinate system (X, Y, Z) shown in FIG. 39. The X-Y plane is parallel to the upper surface of the lower limit portion 3142. The angle $\alpha$ between the inclined portion 317 and the X-Y plane is set to be $0<\alpha\geq 20°$, preferably $5°\alpha\leq 15°$. The angle $\beta$ between the positioning portion 313 and the X-Z plane is set to be $10°\leq\beta\leq 50°$, preferably $20°\leq\beta\leq 40°$. By adjusting $\beta$, the light source module 22 can be fixed in the mounting portion 31. The positioning portion 313 is provided with a spring plate 3131. The angle $\gamma$ between the spring plates 3131 and X-Z is in the range of $28°<\gamma<68°$, preferably $38°\leq\gamma\leq 58°$. When the photoelectric module 2 is damaged and needs to be replaced, the photoelectric module 2 can be slid out of the fixing portion. By designing $\gamma$, the photoelectric module 2 can be conveniently replaced by the user, thereby improving the working efficiency. When the maximum length of the position unit 313 in the Z-axis direction is set to L1, and the photoelectric module 2 is slid into the lower limit position unit 3142, the minimum length of the photoelectric module 2 in the Z-axis direction is set to L2, and the sum of L1 and L2 is larger than the distance D from the upper limit position unit 3141 to the lower limit position unit 3142, so that the fixing effect of the photoelectric module 2 is better.

Figure 40:
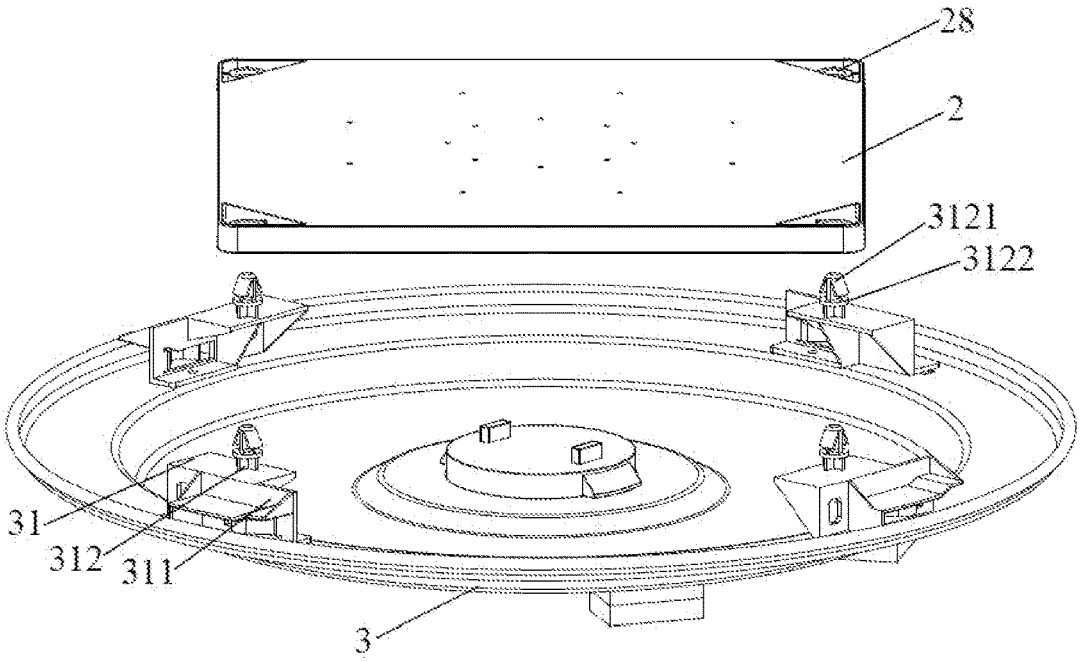
FIG. 40 and FIG. 41 are perspective views of the LED lamp in an embodiment with the lampshade removed.
Figure 41:
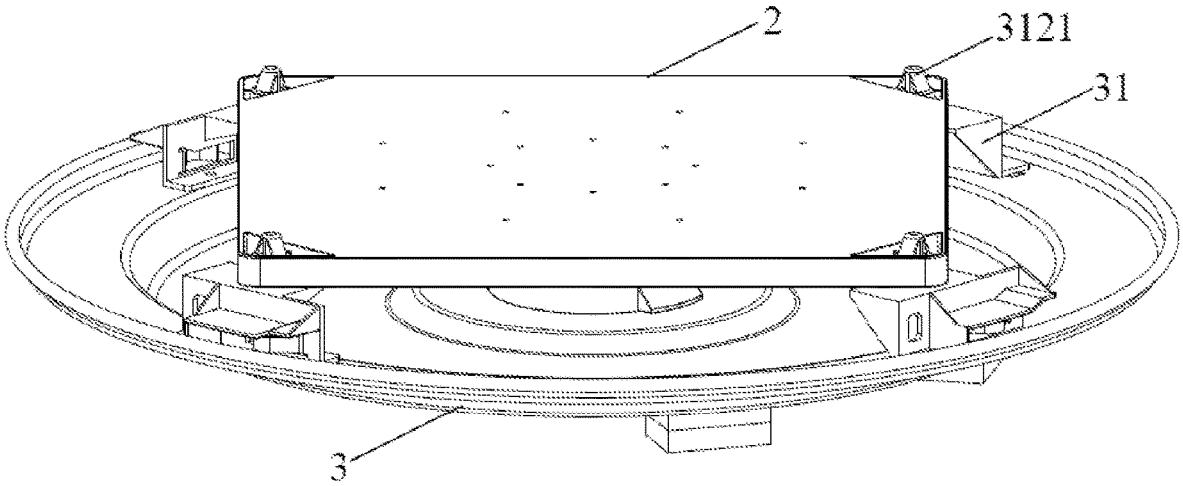

In some embodiments, as shown in FIGS. 40 and 41, there is provided an LED lamp having the same basic structure as the LED lamp (ceiling lamp) of the previous embodiments. The difference is in the specific fixing manner of the photoelectric module 2 and the base 3. Specifically, as shown in FIGS. 40 and 41, the photoelectric module 2 is provided with mounting holes 28, which may be located at both ends of the photoelectric module 2, the base 3 is provided with mounting portions 31, and the number of the mounting holes 28 is the same as the number of the mounting portions 31. The mounting portions 31 include a support portion 311 and a fastener portion 312 fixed to the support portion 311, and the fastener portion 312 includes a telescopic portion 3121 and a limiting portion 3122. When the photoelectric module 2 is installed, the mounting holes 28 on the photoelectric module 2 are aligned with the fastener portion 312, and then a force is applied to the photoelectric module 2 so that the telescopic portion 3121 is forced to compress into the mounting holes 28 of the photoelectric module 2, and the photoelectric module 2 is clamped into a space between the telescopic portion 3121 and the limiting portion 3122. The height of the mounting hole 28 is not less than the minimum distance between the telescopic portion 3121 and the limiting portion 3122. Preferably, the height of the mounting hole 28 is equal to the minimum distance between the telescopic portion 3121 and the limiting portion 3122. The photoelectric module 2 does not shake during transportation, and the photoelectric module has a good fixing effect. After the installation, as shown in FIG. 41, the operation method is simple, the installation of the user is facilitated, the work efficiency is improved, the fixing effect is good, the production cost is low, and the method is suitable for industrialization.

Referring to FIGS. 26 to 32, the mounting portion 31 further includes a second mounting portion 316, which has been provided for fixing the lampshade 1. Specifically, the lampshade 1 has a wall portion 11, and the lampshade 1 may be provided in a rotating structure. The wall portion 11 has an edge, and the edge of the wall portion 11 is provided with a second protruding portion 1101, and the second protruding portion 1101 projects toward the radially inner side of the lampshade 1 opposite the edge of the wall portion 11. A plurality of second protruding portion 1101 may be provided along the circumferential direction of the lampshade 1. The second mounting portion 316 has a second clamping groove 3114. When the lampshade 1 is fixed to the base 3, the second protruding portion 1101 is snapped into the second clamping groove 3114 to be fixed. In some embodiments, the lampshade 1 engages or disengages the second protruding portion 1101 into or from the second clamping groove 3114 in the form of a rotation (substantially about the axis of the LED lamp). In some embodiments, both sides of the second clamping groove 3114 in the axial direction of the LED lamp are closed by the second mounting portion 316 and the base 3. Therefore, after the second protruding portion 1101 is clamped into the second clamping groove 3114, the second protruding portion 1101 is limited in both sides in the thickness direction of the LED lamp. In other embodiments, both sides of the second clamping groove 3114 in the axial direction of the LED lamp are closed by the structure of the second mounting portion 316 itself to achieve the same function as described above. In some embodiments, the second mounting portion 316 has a positioning unit for positioning the second protruding portion 1101 engaged in the second clamping groove 3114. Specifically, the positioning unit includes a second elastic arm 3115, and a second groove 3116 is formed between the second elastic arm 3115 and the second mounting portion 316. In the fixed position, the second protruding portion 1101 is engaged in the second groove 3116 at the end portion of the LED lamp in the radial direction, so as to fix the positioning of the lampshade 1. A second blocking portion 31151 is formed on the second elastic arm 3115. By the arrangement of the second elastic arm 3115, when the second protruding portion 1101 needs to be disengaged from the second clamping groove 3114 to rotate the lampshade 1, it is necessary to first overcome the obstruction of the second blocking portion 31151 (that is, it is necessary to force the lampshade 1 so that the second protruding portion 1101 presses the second elastic arm 3115 so as to be released), thereby preventing the lampshade 1 from being released from the second clamping groove 3114 due to misoperation, collision, or the like. In this embodiment, when the lampshade 1 is fixed, the second elastic arm 3115 can be applied to the second protruding portion 1101 to further tighten the lampshade 1. The second elastic arm 3115 may be integrally formed in the second mounting portion 316. The second elastic arm 3115 may be a sheet-like structure having elasticity with its own material properties, which may be made of a material having elasticity in the prior art, such as plastic or metal. The second blocking portion 31151 can be formed directly by bending (or providing bending in the second elastic arm 3115) of the second elastic arm 3115.

The lampshade 1 in the present disclosure may have a different structure. Referring to FIGS. 1 to 48, in some embodiments, the lampshade 1 has a smooth curved surface to prevent a refractive index difference in the cross section of the lampshade 1 from causing uneven light distribution. In some embodiments, the lampshade 1 includes a central portion and a peripheral portion surrounding the central portion, the lampshade 1 has a light diffusing layer containing light diffusing particles, and the density of the light diffusing particles in the central portion is greater than the density of the light diffusing particles in the peripheral portion so that the brightness of the central portion and the peripheral portion of the lamp is uniform. In some embodiments, the lampshade 1 has a plurality of diffusion regions in which a diffusion region overlaps the photoelectric module 2 in the Z-axis direction to improve the flashing of the lamp. In some embodiments, the inner surface or the outer surface of the lampshade 1 may be provided with a brightness enhancing film to distribute light energy emitted from the light source module 2, so that the LED lamps are uniform in light emission and avoid glare generation. The inner surface and the outer surface of the lampshade 1 are opposite each other, and the inner surface of the lampshade 1 is a surface close to the photoelectric module 2. In some embodiments, the lampshade 1 is provided with a through-hole in which a mounting screw for mounting the lampshade 1 to the base 3 is inserted into the through-hole of the lampshade 1 in a clearance manner, and is screwed onto the base 3, whereby even if the lampshade and the base are expanded or contracted due to a temperature change due to opening and closing of the lamp, stress caused by expansion or contraction can be reduced through the clearance manner, and breakage or noise of the lampshade 1 and the appliance can be prevented.

In other embodiments, a light guide plate may be provided between the lampshade 1 and the first insulating portion 202, and the light guide plate may be, for example, a transparent propylene resin molded body, and the light guide plate may be of a different structure. In some embodiments, the light emission intensity of the end portion of the light guide plate (the end adjacent to the edge of the base 3) is the light emission intensity at an angle corresponding to 30% of the light emission intensity (maximum light emission intensity) in the main light emission direction of the LED chip 2201. In some embodiments, the light guide plate covers the circuit board 201, and the light guide plate has an asymmetric first curved portion and a second curved portion. Light emitted from the LED chip 2201 is partially guided to the first curved portion and partially guided to the second curved portion, so that the light from the lamp is uniformly illuminated. In some embodiments, the surface of the light guide plate may be formed with a point-shaped diffuser to achieve uniform light emission of the light-emitting surface. In some embodiments, the light guide plate includes a main light guide portion that guides light emitted from the LED chip

2201 toward the outer periphery of the light guide plate and an auxiliary light guide portion that guides and diverges light from the LED chip 2201 toward the central portion of the LED lamp. In some embodiments, the light guide plate includes a lead-in unit for introducing light into the interior of the LED lamp and a lead-out unit for guiding light to the exterior of the LED lamp, so that luminance unevenness and glare of the light guide plate can be suppressed. In some embodiments, the light guide plate has an inner side surface and an outer side surface corresponding to the inner side surface, and a radius of curvature of the inner side surface is larger than a radius of curvature of the outer side surface, so that a bright spot on the lampshade 1 can be suppressed. In some embodiments, a plurality of LED chipsets 221 are provided on the circuit board 201, the LED chipset 221 includes a plurality of LED chips 2201, and a light emitting surface of the LED chips 2201 faces an incident end surface of the light guide plate. The plurality of LED chipsets 221 are arranged in a linear shape in a length direction of the circuit board 201, a first LED chipset, a second LED chipset, and a third LED chipset are mounted in a linear shape from an end edge in the length direction of the circuit board 201 toward a center line. A first separation distance L1 is provided between the end edge of the circuit board 201 and the first LED chipset, the second separation distance L2 is provided between the first LED chipset and the second LED chipset, and the third separation distance L3 is provided between the second LED chipset and the third LED chipset, wherein L1<L2<L3, so that the light guide plate does not easily generate dark parts. In some embodiments, the light guide plate has a transparent substrate, a plurality of concave prisms are provided on the main surface of the transparent substrate, and the concave prisms are covered with a coating to prevent dust from accumulating in the main surface and the prisms, and the coating thickness is small enough to suppress optical performance degradation of the light guide plate. The arrangement of the light guide plate can be combined with a case in which the arrangement of the LED chips on the circuit board is not mutually exclusive.

In some embodiments, the circuit board 201 is ring-shaped. For example, in the circuit board 201 of the photoelectric module 2*b* in the previous embodiments, a light guide plate may be provided between the lampshade 1 and the first insulating portion 202. The light emitting surface of the LED chip 2201 faces the center of the LED lamp. The light guide plate may have a different structure. In some embodiments, the thickness of the light guide plate is inclined, and the thickness of the light guide plate decreases gradually from the peripheral portion to the central portion, so that the brightness of the light guide plate is uniform. In some embodiments, the circuit board 201 is provided with a first LED chipset and a second LED chipset, the first LED chipset is incident from an incident end face of the first light guide plate, the second LED chipset is incident from the second light guide plate, incident light is emitted toward the upper surface and the lower surface of the first light guide plate and the second light guide plate, and the first light guide plate and the second light guide plate have light transmittance in the thickness direction of the first light guide plate and the second light guide plate so that the lamp has a three-dimensional light emitting effect. In one embodiment, the ring-shaped circuit board 201 is sequentially covered with a reflective cover, a light guide plate, and a light collecting cover, the convex portion of the light guide plate is inserted into the concave portion of the reflective cover, the light collecting cover has a lens region covering an exit surface inside the light guide plate, and the lens region is optically opposed to the concave reflective portion on the light guide plate, so that light emitted from the LED lamp has a narrow orientation.

Figure 42:
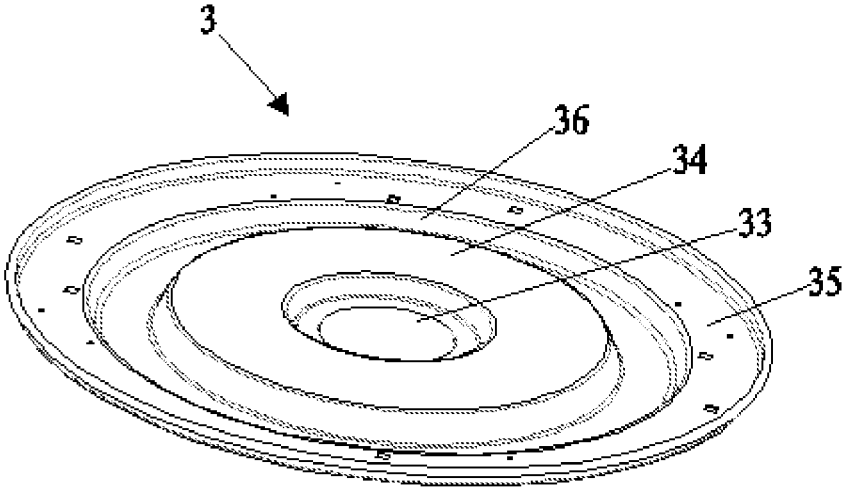
FIG. 42 is a perspective view of a base according to an embodiment of the present disclosure.
Figure 43:
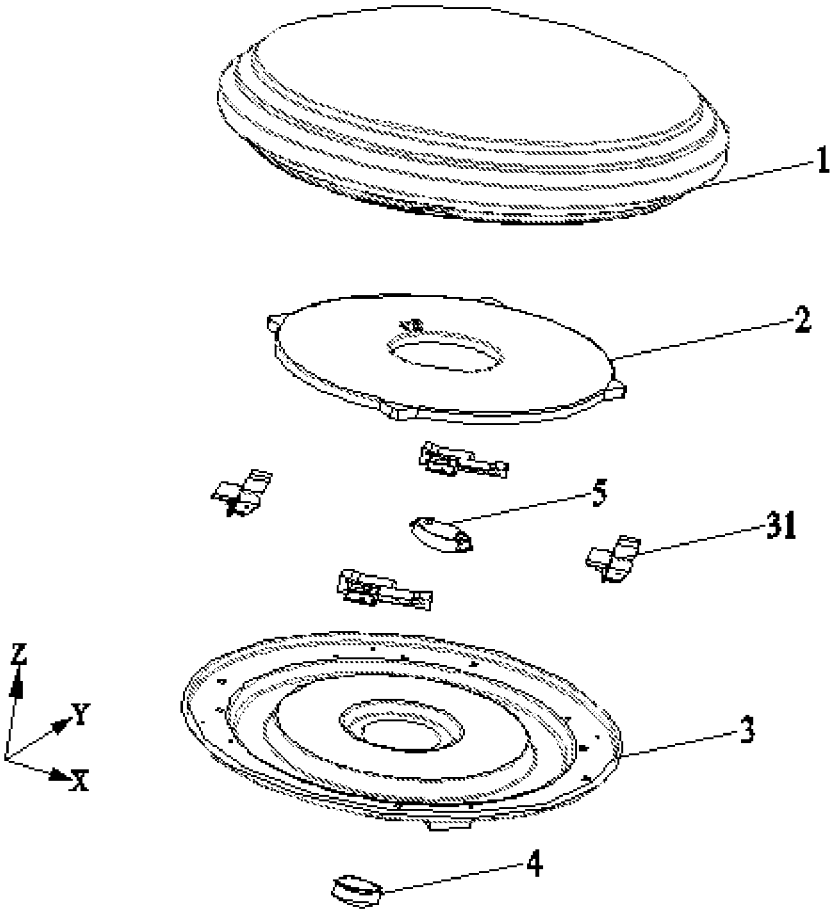
FIG. 43 is a perspective view of an LED lamp according to an embodiment of the present disclosure.

FIG. 42 is a schematic structural diagram of an embodiment of a base in an LED lamp according to the present disclosure. The base 3 is located in a spatial right-angle coordinate system (X, Y, Z), wherein the Z-axis is parallel to the central axis of the LED lamp, and the base 3 is disk-shaped, for example, made of an aluminum plate or a steel plate. As shown in FIGS. 42 and 43, a hole 33 is formed in the central portion of the base 3, and a supporting portion 34 and an edge portion 35 are formed around the hole 33. A space is formed between the supporting portion 34 and the edge portion 35, and the space extends in the negative direction along the Z-axis to form a groove portion 36. The supporting portion 34 and the edge portion 35 are in the same position in the positive direction along the Z-axis. In other embodiments, the supporting portion 34 and the edge portion 35 are in different positions in the positive direction along the Z-axis. For example, the height of the supporting portion 34 in the positive direction along the Z-axis is larger than the edge portion 35. The photoelectric module 2 has an upper surface and a lower surface opposite to the upper surface. The lower surface of the photoelectric module 2 is far away from the lampshade 1, and the lower surface of the lampshade 1 is in surface contact with the support portion 34, so that heat generated by the photoelectric module 2 is transferred out through the base 3, thereby increasing the heat dissipation speed. In other embodiments, the photoelectric module 2 and the support portion 34 are not in a fully-adhered surface contact state. A part of the gap between the photoelectric module 2 and the support portion 34 may be filled with some of the thermally conductive adhesive layer. Heat generated by the operation of the LED chip 2201 can be quickly delivered to the base 3 through the circuit board 201 and the thermally conductive adhesive layer, thereby improving the heat dissipation capability.

In some embodiments, the base 3 may be provided with a brightness sensor, and a mounting position of the brightness sensor is provided at a position where there is no direct light from the LED lamp. The lighting condition of the LED lamp is continuously adjusted according to the brightness increase caused by the external light, so as to realize energy saving and reduce the environmental load, while suitably suppressing excessive power consumption. In some embodiments, the base 3 is provided with reinforcing ribs to increase the strength of the base 3 and reduce the thickness of the base 3.

A user generally sets a time for waking up the user through a remote controller. In order to determine that a light fixture has received a signal from the remote controller, the user is now generally reminded by an electronic sound of a buzzer. However, the buzzer is generally disposed on a circuit board having two-sided wiring. For a circuit board having one-sided wiring, a sound generating element needs to be mounted on one side of the circuit board close to the ceiling. Sound generated by the sound generating element is transmitted to the user with a low volume due to a barrier such as the circuit board. In some embodiments, the base 3 is provided with an opposing portion disposed opposite to the circuit board 201, the circuit board 201 is provided with an opening corresponding to the opposing portion, the sound generating element is mounted on a surface different from the LED chip 2201, and when the sound generating element generates a sound, the sound is reflected from the opposing portion and then transmitted through the opening to ensure that the user can obtain a desired volume.

Figure 44:
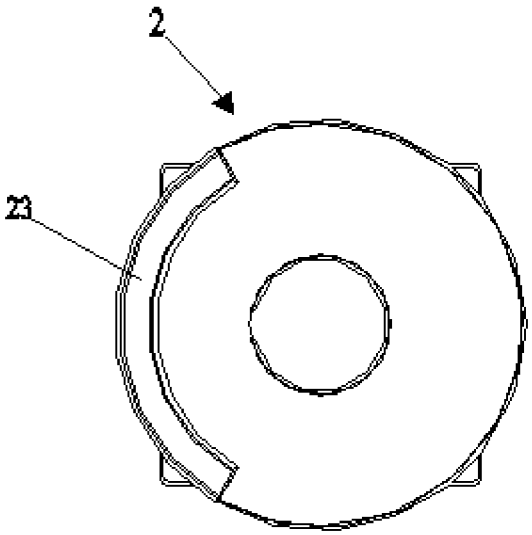
FIG. 44 and FIG. 45 are perspective views of a photoelectric module of the LED lamp according to an embodiment of the present disclosure.
Figure 45:
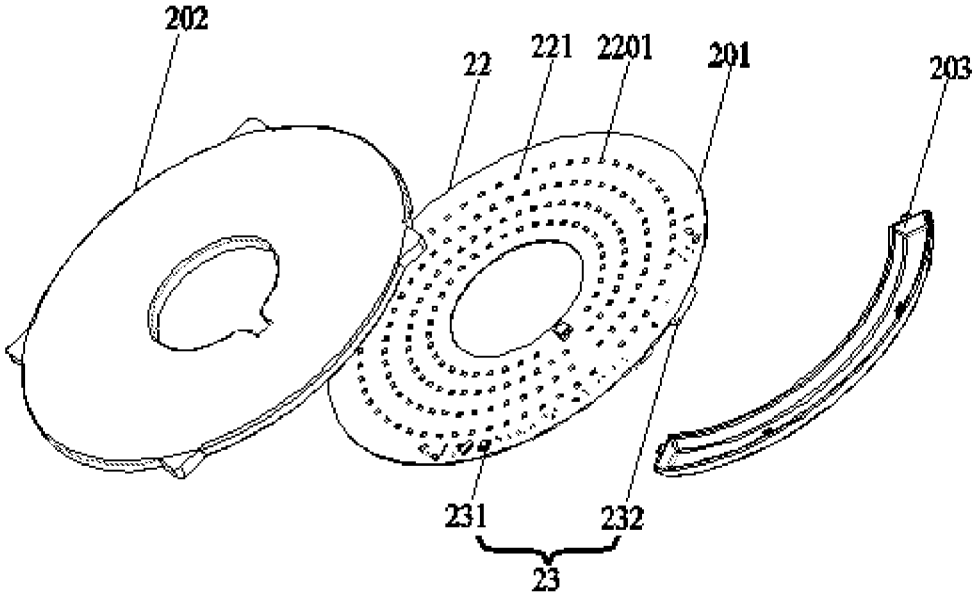

FIG. 44 is a schematic structural diagram of an embodiment of the photoelectric module according to the present disclosure. Referring to FIGS. 42 to 45, the photoelectric module 2 is provided with a power supply module 23 at a position relative to the groove portion 36. The power supply module 23 include a first power supply module 231 and a second power supply module 232. The height of the second power supply module 232 in the Z-axis positive direction is greater than the first power supply module 231 (or the height of the LED chip 2201). After the ceiling lamp is mounted, the second power supply module 232 is located into the groove portion 36 of the base 3. Preferably, the second insulating portion 203 is in contact with the side wall of the groove portion 36 to increase the contact area and improve the heat conductivity. The LED lamp is thinned (that is, the height in the Z-axis direction is shortened) and the packaging and inventory costs are reduced because the storage space for the second power supply module 232, for example, does not need to be accommodated on the base 3. In addition, the photoelectric module 2 can be moved away from the lampshade 1 to increase the amount of light from the light source module 22 to the edge of the lampshade 1. In other words, in the case of the flat view lampshade 1, the edge of the lampshade 1 can be brightened. As a result, for example, the light emitted from the LED lamp can irradiate a wider range.

In some embodiments, the diameter of the base 3 is larger than the diameter of the lampshade 1, and the base 3 is provided with a sub-light-emitting portion in an area outside the lampshade 1, so that the irradiation range of the LED lamp can be effectively increased. In some embodiments, the base 3 is provided with a gasket, a plurality of convex portions protruding from the surface of the gasket, and the lampshade 1 is provided with a concave portion corresponding to the convex portion of the gasket, the depth of the concave portion being greater than the height at which the convex portion protrudes from the surface of the gasket. When the convex portion of the lampshade is fitted into the concave portion of the gasket, the peripheral edge of the lampshade 1 is pressed against the gasket, and a gap between the convex portion and the convex portion is eliminated, thereby effectively preventing insects from entering the lampshade 1.

Figure 47:
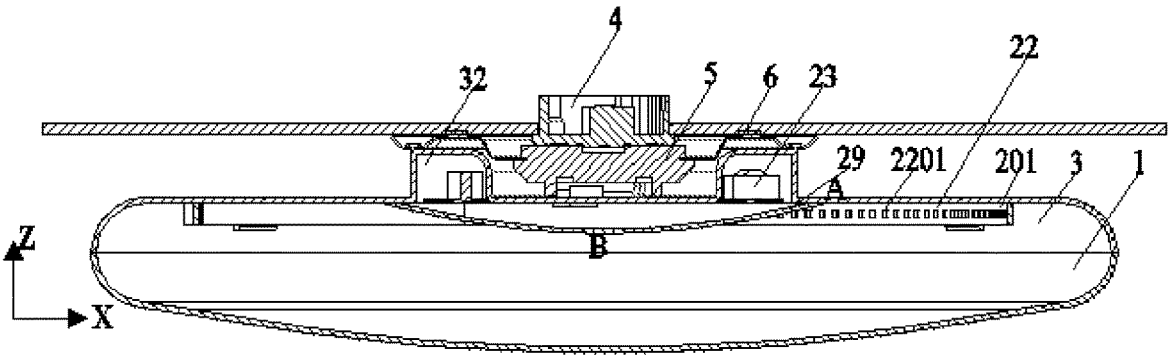

FIGS. 46 and 47 are schematic structural diagrams of an embodiment of an LED lamp according to the present disclosure. The LED lamp includes a lampshade 1, a photoelectric module 2, and a base 3. The basic structure of the LED lamp is the same as that of the previous embodiments. The description is not repeated herein except that the LED lamp uses the photoelectric module 2*b* described above. The structure of the photoelectric module 2*b* is described with reference to the previous embodiments. As shown in FIGS. 46 and 47, a Cartesian coordinate system having an X-axis, a Y-axis, and Z-axis is oriented for the LED lamp, and the Z-axis is parallel to the central axis of the LED lamp, and the LED lamp further includes a baseplate 6 connected to the base 3. The reflective member 29 has an end point A and an apex B. The end point A is located between the LED light source module 22 and the power supply module 23. The apex B is the highest point in the negative Z-axis direction. Then, the height of the reflective member 29 (or the distance from the apex B to the end A in the Z-axis direction) $z=(a^2+b^2-2ab\cos\alpha)^{1/2}*\sin\beta$. a is the linear distance from the LED chip 2201 to the end point A; b is the linear distance from the LED chip 2201 to the apex B; $\alpha$ is an included angle between the straight line from the LED chip 2201 to the end point A and the straight line from the LED chip 2201 to the apex B, $\alpha$ is smaller than the light emitting angle of the LED chip 2201, that is, $0<\alpha<120°$; $\beta$ is the angle between the straight line AB (the line connecting the end point A and the end point B) and the X-axis direction. By designing $\alpha$ and $\beta$, the height of the reflective member can be adjusted to obtain an excellent reflective effect, thereby obtaining a better light distribution. In one embodiment, the reflective member 29 is arched in a direction away from the power supply module 23 (i.e., the negative direction of the Z-axis), so that the heat dissipation space of the power supply module 23 can be increased on the one hand. On the other hand, the power supply module 23 can be completely covered to function as an insulation to prevent electric shock. In some embodiments, the power supply module 23 may be secured to the base 3 by gluing or snapping. In some embodiments, as shown in FIG. 47, the base 3 may be provided with a recess 32 in which electrical components (e.g., inductors, capacitors, etc.) in the power supply module 23 may be located. The recess 32 may increase the heat dissipation space for the electrical components, and may also shorten the heat dissipation path, thereby reducing the temperature of the power supply module 23.

Figure 48:
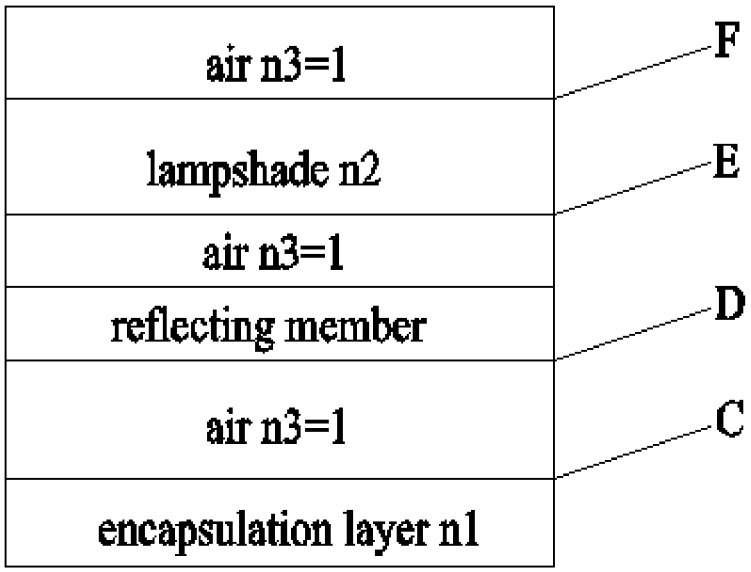
FIG. 48 is an interface diagram of light emitted by LED chips according to an embodiment of the present disclosure.

The LED chip 2201 includes LED beads. As shown in FIG. 48, light emitted from the LED beads passes through four interfaces C, D, E, and F. The C interface is the interface between the encapsulation layer of the LED beads and the air, the D interface is the interface between the air and the reflective member 29, the E interface is the interface between the air and the lampshade, and the F interface is the interface between the lampshade and the air. It is assumed that the refractive index of the encapsulation layer of the LED beads is n1, the refractive index of the lampshade is n2, and the refractive index of the air is n3. In order to improve the utilization rate of light, the reflections of the C, E, and F interfaces are mainly reduced, and the reflections of the D interfaces are improved. The reflection at the interfaces C, E and F reduces the luminous flux of the LED lamp. Therefore, it is necessary to select the material of the encapsulation layer of the LED lamp beads and the lampshade. According to the relationship between the reflectivity and the refractive index, $1-(n1-1)^2/(n1+1)^2-(n2-1)^2/(n2+1)^2>0.9$ may be provided when the light is incident perpendicularly at the interfaces C and F. By selecting the material of the appropriate refractive index, the luminous flux of the LED lamp can be effectively increased.

Further, since the n1 and the n2 are both larger than the n3, total internal reflection occurs when the incident angle is larger than the critical angle. To reduce reflection of the C interface and the E interface, a first refractive index matching layer and a second refractive index matching layer may be provided on the surface of the LED chip 2201 and the inner surface of the lampshade 1, respectively. The refractive index of the first refractive index matching layer is $n4=(n1*n3)^{1/2}$, and the refractive index of the second refractive index matching layer is $n5=(n2*n3)^{1/2}$. In some embodiments, the range of the n1 is 1.4~1.53, and then the range of n4 is 1.18~1.24. In some embodiments, the range of the n2 is 1.5~1.7, then n5 ranges from 1.22~1.3, where $0.16\le n1-n4\le 0.35$, $0.18\le n4-n3\le 0.24$; $0.2\le n2-n5\le 0.48$ and $0.22\le n5-n1\le 0.3$, it can be seen that after the first refractive index matching layer and the second refractive index matching layer are provided, reflection of light can be effectively reduced, and utilization rate of light can be improved.

With respect to the thickness d1 of the first refractive index matching layer and the thickness d2 of the second refractive index matching layer, the reflected light interference can be canceled to further reduce the reflection of the light. Since n1>n4>n3, there is no half-wave loss. Since the wavelength range of the visible light is 400~760 nm, in order to reduce the harm of the blue light to the human eye and improve the comfort of the human body to the light, it is necessary to increase the reflection of the blue light and reduce the reflection of the red light, and the reflection of the blue light can be mainly increased when the first refractive index matching layer is used. Thus, the thickness of the first refractive index matching layer is $d1=(2k+1)\ \lambda/[4*((n4^2-n1^2*\sin\alpha^2)^{1/2})]$, (k=0, 1, 2, 3 . . . ), α is the incident angle at which the light enters the first refractive index matching layer from the encapsulation layer of the LED bead, and λ, is the wavelength of the blue light.

The second refractive index matching layer mainly reduces reflection of red light, and the thickness of the second refractive index matching layer is $d2=k\lambda/[2*(n5^2-n2^2*\sin\beta^2)^{1/2}])$ (k=1, 2, 3 . . . ). β is the angle of incidence of light from the lampshade into the second index matching layer, and λ is the wavelength of red light. By the arrangement of the above two layers, it is possible to achieve a better color temperature of the LED lamp, so that the room has a warm and comfortable atmosphere.

In other embodiments, the first refractive index matching layer may be provided to mainly reduce reflection of red light, $d1=K\lambda/[2*(n4^2-n1^2*\sin\alpha^2)^{1/2}]$ (k=1, 2, 3 . . . ), α is the incident angle at which light enters the first refractive index matching layer from the encapsulation layer of the LED bead, λ is the wavelength of red light, and the second refractive index matching layer is mainly increased in reflection of blue light, $d2=(2k+1)\ \lambda/[4*((n5^2-n2^2*\sin\beta^2))]$, (k=0, 1, 2, 3 . . . ), β is the incident angle at which light enters the second refractive index matching layer from the lampshade, and λ is the wavelength of blue light.

In one embodiment, a multilayer optical film may be provided on the outer surface of the lampshade 1, and light is transmitted from the lampshade 1 to the air transmission direction. The refractive index of the multilayer optical film is $n_H$, $n_L$, $n_H$, $n_L$ . . . $n_H$, respectively, H defines a high refractive index film, and L defines a low refractive index film. In other embodiments, the optical thicknesses of the multilayer optical films are 0.5λ1, 0.25λ2, 0.5λ1, 0.25λ2, . . . , 0.5λ1, respectively; λ1 is the wavelength of blue light, and λ2 is the wavelength of red light, respectively, in the direction of the light transmission from the lampshade 1 to the air. Since the wavelength range of the visible light is wide, the single-layer optical film does not have a good anti-reflection or anti-reflection effect. Using the multi-layer optical film, anti-reflection or anti-reflection of light of different wavelengths can be performed according to the color rendering index or color temperature requirements of the lamp to obtain an excellent light output effect.

The LED lamps of the present disclosure may also be provided with some other structure. In some embodiments, an auxiliary light source is provided in the LED lamp, and the auxiliary light source emits light obliquely upward and radiates the light to the ceiling, thereby improving the sense of brightness of the space. In some embodiments, the height (h) and width (w) of the lamp satisfy the relationship $4\leq w/h\leq 9$. Thus, it is possible to realize a lighting appliance capable of obtaining illumination light of a desired brightness and a desired light distribution as a top lamp, while reducing heavy indentation due to the presence of the appliance body. In some embodiments, the lampshade 1 is connected to the base 3 by a snap connection, and the gap between the lampshade 1 and the base 3 is provided with a repellent retaining layer containing an insect repellent, thereby effectively preventing insects from entering the interior of the lamp. In some embodiments, a backlight source is provided at a position perpendicular to the circuit board 201, and the number of LED chips of the backlight source on the side away from the base 3 is larger than the number of LED chips of the backlight source on the side adjacent to the base 3, so that the illuminance of the light-emitting surface is uniform.

The term "LED chip" mentioned in all embodiments of the present disclosure means all light sources with one or more LEDs (light emitting diodes) as a main part, and includes but is not limited to an LED bead, an LED strip or an LED filament. Thus, the LED chip mentioned herein may be equivalent to an LED bead, an LED strip or an LED filament.

The various embodiment features of the present application described above may be transformed in any combination without being mutually exclusive, and are not limited to a specific embodiment. For example, in the embodiment shown in FIG. 18, although these features may not be described in the embodiment shown in FIG. 43, the features described in the embodiment shown in FIG. 18 may be included, but it will be apparent to those of ordinary skill in the art that such features may be applied to FIG. 43 without inventive step in light of the description in FIG. 18. For another example, although various creation schemes have been described in the present disclosure using an LED ceiling lamp as an example, it is obvious that these designs can be applied to other shapes or types of lamps without inventive step and are not listed herein.

The various embodiments of the lampshade, the photoelectric module, the base, and the LED lamps to which the LED lamps are applied in the present disclosure have been implemented as previously described, and it is recalled that features such as lampshade, circuit board, insulating unit, arrangement of LED chips, base and other feature. The corresponding content may be selected from one or a combination of the features contained in the corresponding embodiment.

While the embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention. The disclosure of all articles and references, including patent applications and publications, is hereby incorporated by reference for all purposes. The omission of any aspect of the subject matter disclosed herein in the preceding claims is not intended to abandon the subject matter, nor should the inventor be considered to have considered the subject matter as part of the disclosed subject matter.

What is claimed is:

1. An LED lamp comprising:

a lampshade;

a base, connected to the lampshade;

a photoelectric module comprising a light source module and a power supply module, the photoelectric module is disposed in an accommodating space formed between the lampshade and the base, wherein the photoelectric module is detachably fixed to the base through a mounting portion, and a portion of the power supply module and the light source module are located on the same surface.

2. The LED lamp according to claim 1, wherein the photoelectric module further comprises a circuit board having a first side and a second side arranged relatively, the first side of the circuit board is a side facing the lampshade, a plurality of electronic components of the light source module are disposed on the first side of the circuit board, and a plurality of electronic components of the power supply module are disposed on the second side of the circuit board.

3. The LED lamp according to claim 2, wherein the photoelectric module further comprises an insulating unit having a first insulating portion and a second insulating portion, the first insulating portion covers the electronic components on the first side of the circuit board and the second insulating portion covers the electronic components on the second side of the circuit board.

4. The LED lamp according to claim 2, wherein the circuit board comprises a plurality of LED chipsets disposed thereon, each of the plurality of the LED chipsets includes a plurality of LED chips, and each of the plurality of the LED chipsets is located on the same circumference, when the number of the circumference is set to be n, a pitch angle of the LED chips is (90/n)°.

5. The LED lamp according to claim 2, wherein the second side of the circuit board includes a third region provided for the power supply module to be disposed thereon, and a fourth region; wherein the first side of the circuit board includes a first region opposite to the third region and a second region opposite to the fourth region, and the number of the LED chips located in the first region of the first side is less than the number of the LED chips located in the second region of the first side.

6. The LED lamp according to claim 5, wherein the third region of the second side is close to the central axis of the LED lamp, and the fourth region of the second side is far away from the central axis of the LED lamp comparing to the third region of the second side.

7. The LED lamp according to claim 2, wherein the second side of the circuit board includes a seventh region and a eighth region, and an electronic components of the power supply module include a heat generating component and a heat-sensitive component, wherein the heat generating component and the heat-sensitive component are located in the seventh region and the eighth region of the second side, respectively.

8. The LED lamp according to claim 7, wherein the first side of the circuit board includes a fifth region opposite to the seventh region of the second side and a sixth region opposite to the eighth region of the second side, and the number of the LED chips located in the fifth region of the first side is less than the number of the LED chips located in the sixth region of the first side.

9. The LED lamp according to claim 3, wherein the first insulating portion has an arc from the center to the edge of the light source module.

10. The LED lamp according to claim 1, a Cartesian coordinate system having an X-axis, a Y-axis, and Z-axis is oriented for the LED lamp, wherein the Z-axis is parallel to the central axis of the LED lamp, a hole is formed in a central portion of the base, a supporting portion and an edge portion are formed around the hole, a gap formed between the supporting portion and the edge portion extends in a negative direction along the Z-axis to form a groove portion, and the supporting portion and the edge portion are in the same position in the positive direction of the Z-axis.

11. The LED lamp according to claim 10, wherein the photoelectric module and the supporting portion is separately arranged.

12. The LED lamp according to claim 10, wherein the power supply module is located in a position relative to the groove portion.

13. The LED lamp according to claim 3, wherein the mounting portion comprises a first mounting portion having a first clamping groove, and the first insulating portion comprises a first protruding portion protruding from the outer edge of the first insulating portion, where the first insulating portion has a fixing position in which the first protruding portion is engaged with the first clamping groove and a releasing position in which the first protruding portion is separated from the first clamping groove.

14. The LED lamp according to claim 13, wherein the first mounting portion has a positioning unit including a first elastic arm, and a first groove is formed between the first elastic arm and the first mounting portion.

15. The LED lamp according to claim 14, wherein the first protruding portion is engaged in the first groove at the end portion of the LED lamp in the radial direction to fix the positioning of the first insulating portion.

16. The LED lamp according to claim 1, wherein a reflective member is disposed between the LED light source module and the power supply module, and the LED light source module surrounds the reflective member, where the light source module comprises a circuit board and at least one set of the LED chipsets disposed on the circuit board, each of the LED chipsets comprises a plurality of LED chips, and the light emitting surface of the plurality of LED chips faces the central axis of the LED lamp.

17. The LED lamp according to claim 16, wherein the reflective member is arched in a direction away from the power supply module.

18. The LED lamp according to claim 16, wherein a first refractive index matching layer and a second refractive index matching layer are provided on the surface of the LED chip and the inner surface of the lampshade, respectively.

19. The LED lamp according to claim 18, wherein when d1 represents the thickness of the first refractive index matching layer, a represents the incident angle at which the light enters the first refractive index matching layer from the encapsulation layer of the LED bead, and λ represents the wavelength of the blue light, a formula as follow is met: $d1=(2k+1)\lambda/[4*((n42-n12*\sin\alpha2)^{1/2}]$, (k=0, 1, 2, 3 . . . ).

20. The LED lamp according to claim 18, wherein when d2 represents the thickness of the second refractive index matching layer, β represents the angle of incidence of light from the lampshade into the second index matching layer, and λ represents the wavelength of red light, a formula as follow is met: $d2=k\lambda/[2*(n52-n22*\sin\beta2)^{1/2}]$, (k=1, 2, 3 . . . ).

* * * * *